US007161537B2

(12) United States Patent
Rafi et al.

(10) Patent No.: US 7,161,537 B2
(45) Date of Patent: Jan. 9, 2007

(54) LOW PROFILE HYBRID PHASED ARRAY ANTENNA SYSTEM CONFIGURATION AND ELEMENT

(75) Inventors: Gholamreza Rafi, Kitchener (CA); Iraj Ehtezazi Alamdari, Waterloo (CA); Pedram Mousavi Bafrooei, Waterloo (CA); Safeiddin Safavi-Naeini, Waterloo (CA); Masoud Kahrizi, Waterloo (CA)

(73) Assignee: Intelwaves Technologies Ltd., Waterloo (CA)

( * ) Notice: Subject to any disclaimer, the term of this patent is extended or adjusted under 35 U.S.C. 154(b) by 0 days.

(21) Appl. No.: 11/115,282

(22) Filed: Apr. 27, 2005

(65) Prior Publication Data

US 2005/0243005 A1 Nov. 3, 2005

Related U.S. Application Data

(60) Provisional application No. 60/565,515, filed on Apr. 27, 2004.

(51) Int. Cl.
*H01Q 1/38* (2006.01)
*H01Q 13/10* (2006.01)

(52) U.S. Cl. ..... 343/700 MS; 343/767; 343/769

(58) Field of Classification Search ..... 343/700 MS, 343/767, 769

See application file for complete search history.

(56) References Cited

U.S. PATENT DOCUMENTS

| | | | | |
|---|---|---|---|---|
| 4,866,451 | A | 9/1989 | Chen | |
| 5,173,711 | A * | 12/1992 | Takeuchi et al. | 343/700 MS |
| 5,241,322 | A * | 8/1993 | Gegan | 343/700 MS |
| 5,400,041 | A * | 3/1995 | Strickland | 343/700 MS |
| 5,835,057 | A | 11/1998 | van Heyningen | |
| 5,966,102 | A | 10/1999 | Runyon | |
| 6,014,105 | A * | 1/2000 | Davis et al. | 343/700 MS |
| 6,496,148 | B1 * | 12/2002 | Ngounou Kouam et al. | 343/700 MS |
| 6,856,300 | B1 | 2/2005 | McCarrick | |
| 7,038,631 | B1 * | 5/2006 | Jecko et al. | 343/767 |
| 2003/0011521 | A1 * | 1/2003 | Edimo et al. | 343/700 MS |

OTHER PUBLICATIONS

Rafi et al., "Wideband Microstrip Patch Antennas with V-Slot and Patch-Via Resonators", *In Proc. ANTEM202 Symp.*, pp. 3741-3744, Aug. 2002.

Rafi et al., "Circular-Arc Single Layer Microstrip Antenna for Wideband Applications", *In Proc. ANTEM202 Symp.*, pp. 260-263, Aug. 2002.

Rafi et al., "Wideband V-Slotted Diamond-Shaped Microstrip Patch Antenna", *Electronic Letters*, vol. 40, No. 19, Sep. 16, 2004.

Rafi et al., "Broadband Microstrip Patch Antenna With V-Slot", *Proc.-Microw. Antennas Propag.*, vol. 151, No. 5, Oct. 2004.

* cited by examiner

*Primary Examiner*—Trinh Vo Dinh
(74) *Attorney, Agent, or Firm*—Curtis B. Behmann; Borden Ladner Gervais LLP

(57) ABSTRACT

A microstrip patch antenna is provided having a high gain performance with a smaller size compared to existing approaches. The antenna includes a patch having a polygon shape, such as a convex polygon, and a modified V-slot in the polygon patch including high-frequency control segments. Such an antenna has a dual band performance, such as in the Ka and Ku bands. An array of antenna elements is also described, as well as an ultra low profile phased array antenna system.

20 Claims, 21 Drawing Sheets

LOW PROFILE HYBRID PHASED ARRAY ANTENNA SYSTEM CONFIGURATION AND ELEMENT

CROSS REFERENCE TO RELATED APPLICATIONS

This application claims the benefit of priority of U.S. Provisional Patent Application No. 60/565,515 filed Apr. 27, 2004, which is incorporated herein by reference.

FIELD OF THE INVENTION

The present invention relates generally to antenna elements used for receiving and transmitting data signals, such as from or to a satellite. The present invention also relates to an array of such antenna elements, as well as a system incorporating a plurality of such arrays.

BACKGROUND OF THE INVENTION

Satellite transmission is used for a variety of applications, such as for transmitting television signals, also known as direct broadcast system (DBS) signals. Many arrangements exist for receiving such satellite signals at a home, or at another fixed location. There is a need to be able to receive such signals in a mobile environment, such as in a vehicle. Existing dish technologies are cumbersome and not suitable for use on a vehicle. Some lower profile antennas, having a height of five to six inches, are known.

Microstrip patch antennas are useful in an environment where a low profile is desired. However, a drawback is that a large patch size is typically required in order to obtain a high gain, i.e. the gain of the system is about a 30 to 32 decibel gain, in order to properly receive satellite signals. When such elements are provided in an array, the overall height of the array is also increased.

It is, therefore, desirable to provide an antenna element, also suitable for use in an array, that overcomes at least one of the drawbacks of previous approaches.

SUMMARY OF THE INVENTION

It is an object of the present invention to obviate or mitigate at least one disadvantage of previous antenna elements and arrays.

In a first aspect, the present invention provides a microstrip patch antenna element including a convex polygonal microstrip patch having at least eight side segments configurable with respect to the performance of the antenna. The patch has a modified V-slot, a closed end of the modified V-slot being substantially parallel to the length of the base of the polygonal microstrip patch. The modified V-slot includes a base segment defining the closed end, and left and right V-side configurable segments each having a closed end edge and an open end edge. The modified V-slot also includes left and right high-frequency control segments configurable to independently control response of the antenna element in two frequency bands. The left and right high frequency control portions are provided between and join an end of the base portion and the closed end edge of the left and right V-side portions, respectively. The polygonal microstrip patch and the modified V-slot co-operate to provide high-frequency, high-gain dual-band operation.

The left and right high frequency control segments can be provided at an obtuse angle to the end of the base portion in a direction away from the base of the polygonal microstrip patch. The left and right high-frequency control segments can be configurable to independently control a first frequency band lower limit and a first frequency band upper limit, and/or a second frequency band lower limit and a second frequency band upper limit.

The left and right V-side segments can be provided at an obtuse angle to the left and right high-frequency control segments, respectively, in a direction away from the base of the microstrip patch. The polygonal microstrip patch and the modified V-slot can be substantially symmetrical with respect to a center axis perpendicular to the base of the microstrip patch. The modified V-slot can be provided substantially in the center of the polygonal microstrip patch.

The antenna element can further include left and right additional high-frequency control segments provided at the open end edge of the left and right V-side segments, respectively. The antenna element can further include a feeding point, such as a via, provided substantially in the middle of the antenna element so that an offset length substantially equals zero, or any other offset. The antenna element can further include a probe surrounding the feeding point and provided generally within a space bounded by the portions of the modified V-slot.

The two frequency bands can comprise the Ku band and/or the Ka band. The two frequency bands in the dual band operation can include a 11.5–12.5 GHz reception band and a 14–14.5 GHz transmission band.

In further aspect, the present invention provides a microstrip patch antenna system comprising a patch antenna layer having an antenna element. The antenna element can be a microstrip patch antenna element as described above. The microstrip patch antenna system further includes a dielectric layer having a via-hole, and a feeding and matching network layer having a wideband impedance matching network connected to the antenna element by way of the via-hole. The matching network includes a truncated circular segment having a first impedance, a feed line segment having a second impedance, and a transformer segment connected between the feed line segment and the truncated circular segment opposite the truncated portion, the transformer segment to match the first impedance and the second impedance.

The feeding and matching network layer can include a feeding network having a power combiner to combine power of a plurality of antenna elements through an impedance transformation. The power combiner can include a T-junction power combiner based on balance of power and phase combination of its inputs.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Figure 1:
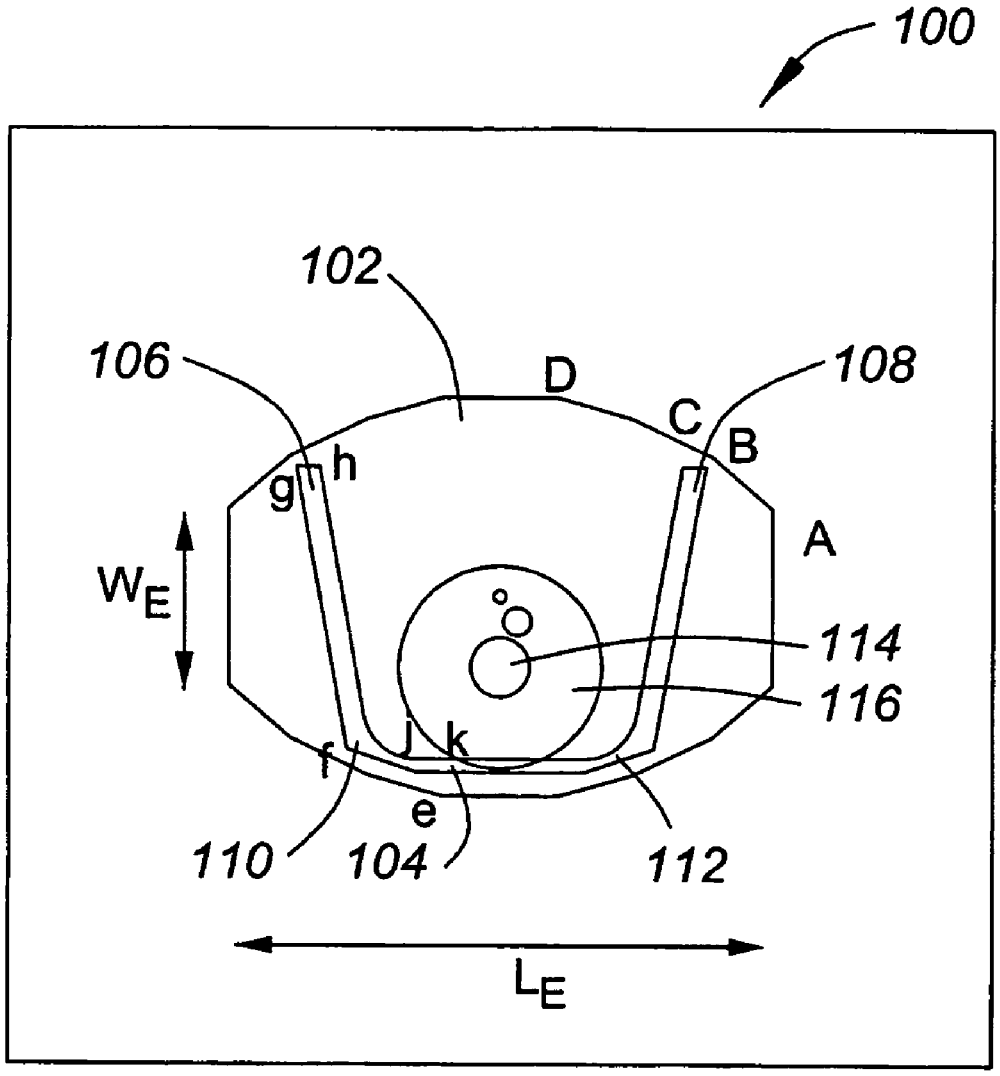
FIG. 1 is a single element folded slotted polygonal patch microstrip antenna according to an embodiment of the present invention.

Generally, the present invention provides a microstrip patch antenna having a high gain performance with a smaller size compared to existing approaches. An antenna according to an embodiment of the present invention includes a patch having a polygon shape and a modified V-slot in the polygon patch including high-frequency control segments. Such an antenna has a dual band performance, such as in the Ka and Ku bands. While some known approaches use a V-slot on a rectangular patch, such known approaches only provide a wideband response and are not able to provide a dual band performance. An array of antenna elements is also described, as well as an ultra low profile phased array antenna system.

The term "high gain" as used herein in relation to an antenna represents an antenna that significantly increases signal strength. High-gain antennas are necessary for long-range wireless networks, and for satellite networks. A high gain antenna is highly focused, whereas a low gain antenna receives or transmits over a wide angle.

The term "high frequency" as used herein represents a frequency above 10 gigahertz, and can preferably include frequencies around 12 gigahertz and up to 14.5 gigahertz.

The term "dual band" as used herein represents a behaviour or response of an antenna element, or an array of elements, that provides a suitable gain for signal reception or transmission in two separate, non-contiguous frequency bands of interest. In contrast, a wideband or broadband response provides signal transmission/reception capabilities over a frequency region that includes both frequency bands of interest and frequency bands that are not of interest. Energy spent enabling transmission/reception in frequency bands that are not of interest is "wasted" and represents a drawback of wideband and broadband approaches. The Ka Band is known as a band having a frequency range of 18–31 GHz. The Ku band is known as Frequency range of 10.7–18 GHz. TV stations and networks frequently use Ku Band to get the signal from their remote satellite trucks back to the TV station. Also, some companies in the U.S. use the Ku Band to deliver high powered DBS satellite service to subscribers.

The term "polygon" as used herein represents a plane figure with at least three straight side segments and angles, and typically five or more. A patch having a "polygonal" shape exhibits these characteristics. A polygonal patch according to an embodiment of the present invention can be a simple polygon, i.e. it is described by a single, non-intersecting boundary. A polygonal patch according to an embodiment of the present invention can preferably be a convex polygon, i.e. a simple polygon that has no internal angles greater than 180°. In a preferred embodiment, the polygonal patch includes at least eight straight side segments, i.e. an octagon. In a presently preferred embodiment, the polygonal patch includes at least ten straight side segments. Properties (such as length, width, etc.) of each of the sides are configurable and provide tunable parameters with respect to the performance/behaviour of the antenna.

The term "V-slot" as used herein represents a slot in a microstrip patch antenna having a base segment joined with two side segments, the general shape of the three segments resembling the shape of the letter "V", but being truncated at the bottom by the base segment. The two side segments of a V-slot are preferably provided at an obtuse angle with respect to the base. In contrast to a V-slot, a U-slot has a base segment and two side segments provided at a right angle to the base segment. The term "modified V-slot" as used herein represents an embodiment of the present invention where a V-slot additionally comprises high-frequency control segments, as will be described in further detail below.

V-Slot Polygonal Antenna Element

In FIG. 1, an antenna 100 is shown according to an embodiment of the present invention including a polygonal shaped patch 102 having a modified V-slot. The polygonal microstrip patch and the modified V-slot can be substantially symmetrical with respect to a center axis perpendicular to the base of the microstrip patch, though such symmetry is not required. The modified V-slot can be provided substantially in the center of the polygonal microstrip patch.

The polygonal patch shape and the modified V-slot co-operate to provide current shaping on the antenna. The multiplicity of sides on the polygon shape provides a higher number of tunable parameters than the following shapes: rectangular; circular; or a patch having a generally rectangular shape but with two opposing sides having an arc shape. A diamond shaped patch having eight straight sides can be implemented as the polygonal patch shape, with a patch having ten straight sides (or more) being a presently preferred implementation. The at least eight side segments are configurable with respect to their length and/or with respect to the angles between the side segments.

Current shaping is performed in order to provide a sufficient current in one direction. Current vector (or distribution) on a patch without a slot has current in two directions; with the inclusion of the V-shaped slot, the current is shaped so that it is in one direction. Some known approaches have used a U-shaped slot on a rectangular microstrip patch in order to attempt to provide a current vector in a single direction. However, the gain of antenna with a U-shaped slot is much lower compared to the gain provided according to embodiments of the present invention. Rectangular microstrip patch antennas have been proposed including a V-slot. While these antenna elements provide good performance in some respects, they are limited to use in wideband or broadband applications.

The V-slot on the microstrip patch according to an embodiment of the present invention includes a base segment 104 joined with two side segments: left V-side segment 106 and right V-side segment 108. The general shape of the three segments resembles the shape of the letter "V", but being truncated at the bottom by the base segment 104.

With respect to the modified V-slot according to an embodiment of the present invention, an extra element is provided as compared to known V-slot designs. Embodiments of the present invention are provided for use in dual band, high gain, high frequency applications. With the limited number of parameters available in known V-slot patch antennas, it is not possible to split the bands in order to be able to vary the performance of the antenna with respect to separate bands. In the modified V-slot according to an embodiment of the present invention, one or more high frequency control segments are provided between the side segments 106 and 108 of the V and the base 104 of the truncated V. In FIG. 1, a left high frequency control segment 110 and right high frequency control segment 112 are provided.

The high frequency control segments 110 and 112 provide control over the frequency band in order to split the frequency band. The high frequency control segments 110 and 112 also provide a good linear polarization at high frequency, good gain at high frequency, and a good input impedance matching at high frequency. As shown in FIG. 1, the left and right V-side segments 106 and 108 can be provided at an obtuse angle to the left and right high-frequency control segments 110 and 112, respectively, in a direction away from the base of the microstrip patch.

In an alternative embodiment, additional high frequency control segments (not shown) can be provided at the top of the two angled sections of the V, in order to provide further tuning capabilities. In such an embodiment, the antenna element can further include left and right additional high-frequency control segments provided at the open end edge of the left and right V-side segments, respectively.

In other words, in an embodiment the present invention provides a microstrip patch antenna element including a convex polygonal microstrip patch having at least eight side segments configurable with respect to the performance of the antenna. The patch has a modified V-slot, a closed end of the modified V-slot being substantially parallel to the length of the base of the polygonal microstrip patch. The modified V-slot includes a base segment defining the closed end, and left and right V-side configurable segments each having a closed end edge and an open end edge. The modified V-slot also includes left and right high-frequency control segments configurable to independently control response of the antenna element in two frequency bands. The left and right high frequency control portions are provided between and joining an end of the base portion and the closed end edge of the left and right V-side portions, respectively. The polygonal microstrip patch and the modified V-slot co-operate to provide high-frequency, high-gain dual-band operation.

The high frequency control segments 110 and 112 provide the ability to split the antenna response into two separate bands, or dual bands, and provides the ability to independently control the response in those two bands. In known wide band patch antenna applications, energy is radiated in areas which are not of interest. Also, the tuning of the response is only available with respect to the two ends of the wide band range and it is typically not possible to independently control the lower and upper ends of the wide band response. These drawbacks are overcome according to embodiments of the present invention.

As shown in FIG. 1, the left and right high frequency control segments can be provided at an obtuse angle to the end of the base portion in a direction away from the base of the polygonal microstrip patch. The left and right high-frequency control segments can be configurable to independently control a first frequency band lower limit and a first frequency band upper limit, and/or a second frequency band lower limit and a second frequency band upper limit The two frequency bands can comprise the Ku band and/or the Ka band. The two frequency bands in the dual band operation can include a 11.5–12.75 GHz reception band and a 14–14.5 GHz transmission band.

The antenna element can further include a feeding point 114, such as a via, provided substantially in the middle of the antenna element so that an offset length substantially equals zero, or any other offset length. The antenna element can further include a probe, or aperture, 116 surrounding the feeding point and provided generally within a space bounded by the portions of the modified V-slot.

Antennae according to an embodiment of the present invention can be used in an Electromagnetic Band Gap (EBG) structure, where elements are provided around the antenna in a periodic manner. Such elements can include resonators. Another option is to provide a second patch on the same or on a different substrate layer, such as above or below a first patch. Providing a periodic structure around the patch provides a high impedance around the patch at a particular frequency, prevents energy from propagating inside the substrate, and forces the energy to be transmitted outside the substrate.

For low frequency applications, it is often sufficient to have a coarse current shaping capability. With respect to high frequency applications, a fine control of the shape is required in order to provide fine current shaping. Current shaping with respect to a diamond shaped patch would generally entail adding another side to the patch. With the polygon shape according to an embodiment of the present invention, there are many more parameters to be controlled. Fine tuning of these parameters can result in fine shaping of the current pattern without requiring the addition of further elements to the patch, the behaviour of which may not be known.

The single and 4-element microstrip polygonal shape patch with a modified V-slot on each element can be provided as a dual band linear polarized microstrip antenna sub-array. The antenna can work at 11.5–12.75 GHz for receiving and 14–14.5 GHz for transmitting mode; these frequency bandwidths are compatible with FSS (Fixed salute system) Standard. Also this antenna can be incorporated in an array configuration with sequential feeding for DBS application.

Antenna Geometry

According to embodiments of the present invention, the shape of the microstrip patch is preferably provided as a polygon and a V-slot is placed at the patch center. Alternatively, a diamond shape/arc can be used as the patch shape. In this manner, with a single-layer patch, the impedance bandwidth of the patch is increased to about 50% and it is possible to make dual band antenna for FSS and DBS application.

Referring again to FIG. 1, an exemplary geometry of an antenna according to an embodiment of the present invention is shown. The antenna is a single-layer microstrip patch having a convex polygon shape and embedded modified V-shaped slot. The patch main dimensions are its length $L_E$ and width $W_E$, and its sub-dimensions are truncation length l and w. The diamond or polygonal shape of the patch increases its length, thereby exciting its next higher-order mode, horizontal in FIG. 1. However, because of the reduction of patch width towards its end, the excitation of this higher-order mode is not very strong and the patch still radiates a strong vertically polarized field. Consequently, placing this weakly excited mode between the patch dominant vertical mode and V-slot mode, increases the antenna bandwidth (and make it possible for dual band application) considerably. The antenna vertically polarized co-polar gain remains high and relatively stable within the entire antenna impedance bandwidth.

Figure 2:
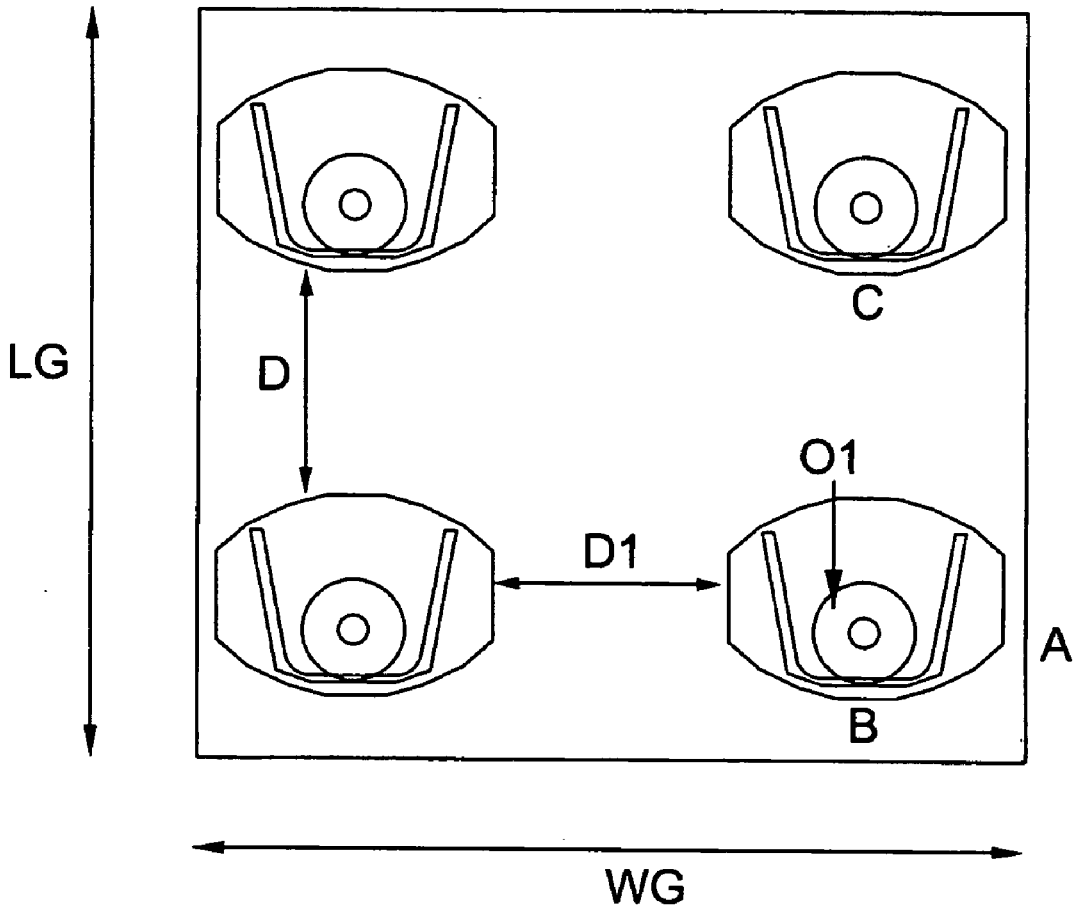
FIG. 2 is a four element folded slotted polygonal patch microstrip antenna sub-array according to an embodiment of the present invention.

Single element and 4-element modified V-slot polygonal patch microstrip antennas with a probe feed on the RT/Duroid dielectric substrate are shown in FIG. 1 and FIG. 2, respectively. These elements are fed by coaxial probe or via to maintain linear polarization for the antenna. The folded slot parameters are optimized to achieve dual band impedance matching for a given transmitting and receiving mode.

The geometry of the exemplary embodiment of the single antenna element in FIG. 1 can be described by the following parameters: Substrate: RT/Duroid 5880; $\epsilon_r$=2.2; Tan d=0.0009; H=1.575 mm (62 mil). Polygon Shape: $L_E$=11.2 mm; $W_E$=8.4 mm; A=(−0.19, 0.56); B=(−0.28, 0.47); C=(−0.37, 0.28); D=(−0.42, 0.1); LG=WG=20 mm. V-shape slot: $L_E$=11.2 mm; $W_E$=8.4 mm; e=(−0.37, −0.19); f=(−0.28, 0.47); g=(−0.28, −0.42); h=(−0.28, −0.32); i=(0.28, −0.28); j=(0.33, −0.23); k=(0.34, −0.14).

The geometry of the exemplary embodiment of the four element (2×2) sub-array in FIG. 2 can be described by the following parameters: Substrate: RT/Duroid 5880; $\epsilon_r$=2.2; Tan d=0.0009; H=1.575 mm (62 mil). Polygon Shape: $L_E$=11.2 mm; $W_E$=8.4 mm; A=(1.19 1.65); B=(1.7, 1.2); O1=(1.15, 1.1); D=1.14 mm; D1=1.18 mm; LG=WG=30 mm.

Figure 3:
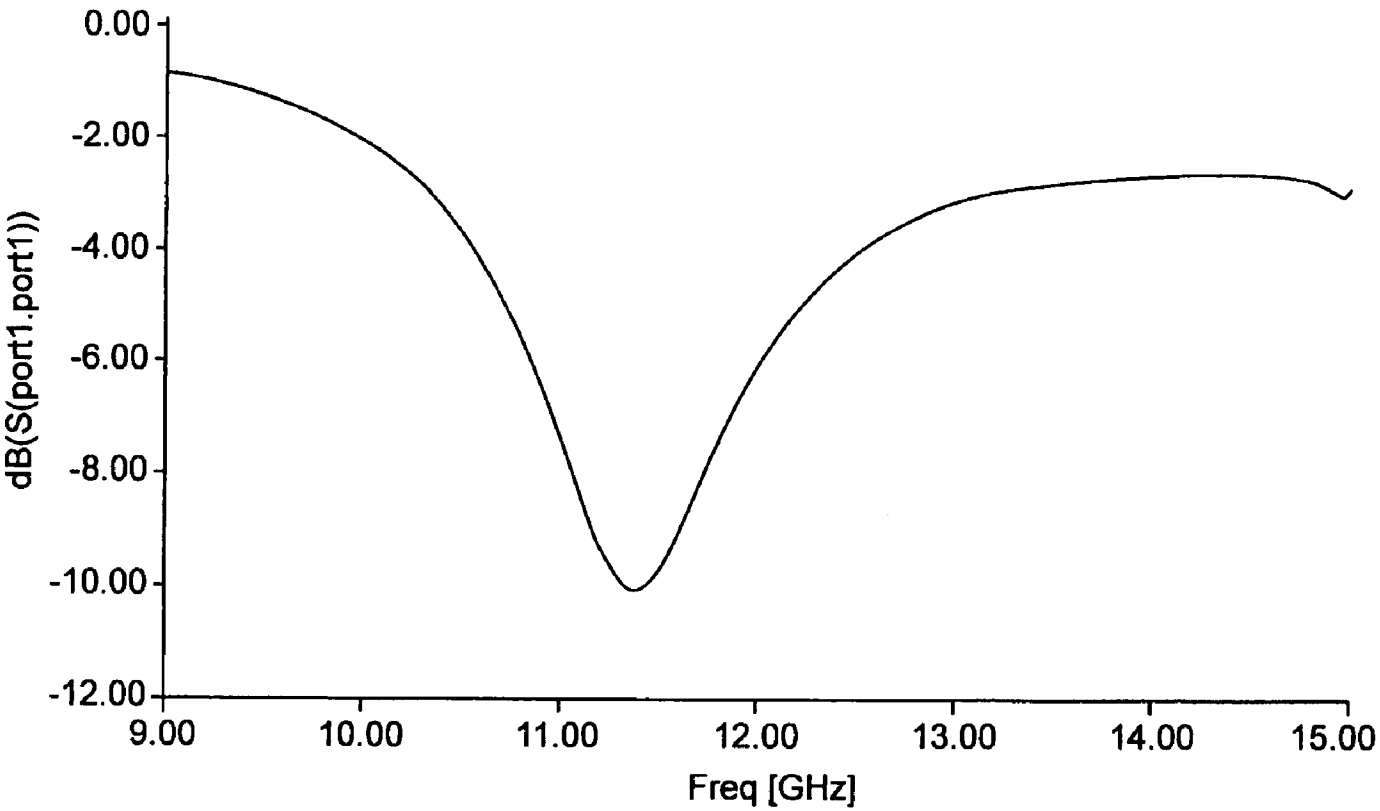
FIG. 3 is a graph illustrating return losses for the antenna of FIG. 1 if it were not to include the modified V-slot, with the remaining parameters being the same as FIG. 1.
Figure 4:
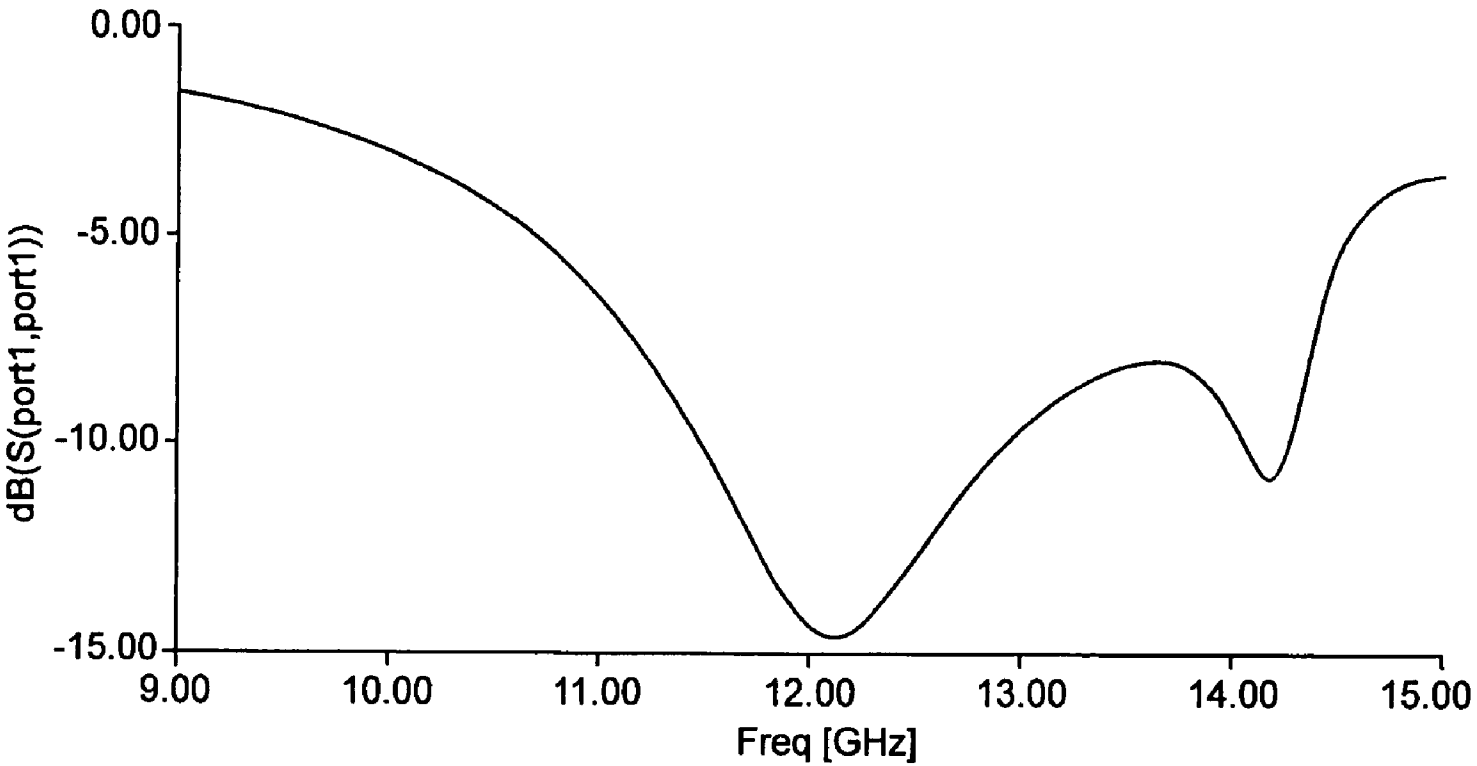
FIG. 4 is a graph illustrating return losses for the antenna of FIG. 1.

FIG. 3 is a graph illustrating return losses for the antenna of FIG. 1 without the folded modified V-slot, with the remaining parameters being the same as FIG. 1. FIG. 4 is a graph illustrating return losses for the antenna of FIG. 1 with the folded modified V-slot. A comparison of FIG. 3 and 4 demonstrates that the provision of the modified V-slot, including the high-frequency control segments, provides a dual band performance. FIGS. 3 and 4 represent variation of the return loss versus frequency for antenna with and without folded slot, with same polygonal patch shape. The antenna with folded slot bandwidth based on −10 dB return loss is from 11.4 GHz to 12.5 GHz which covers a receiving mode frequency bandwidth.

Figure 5:
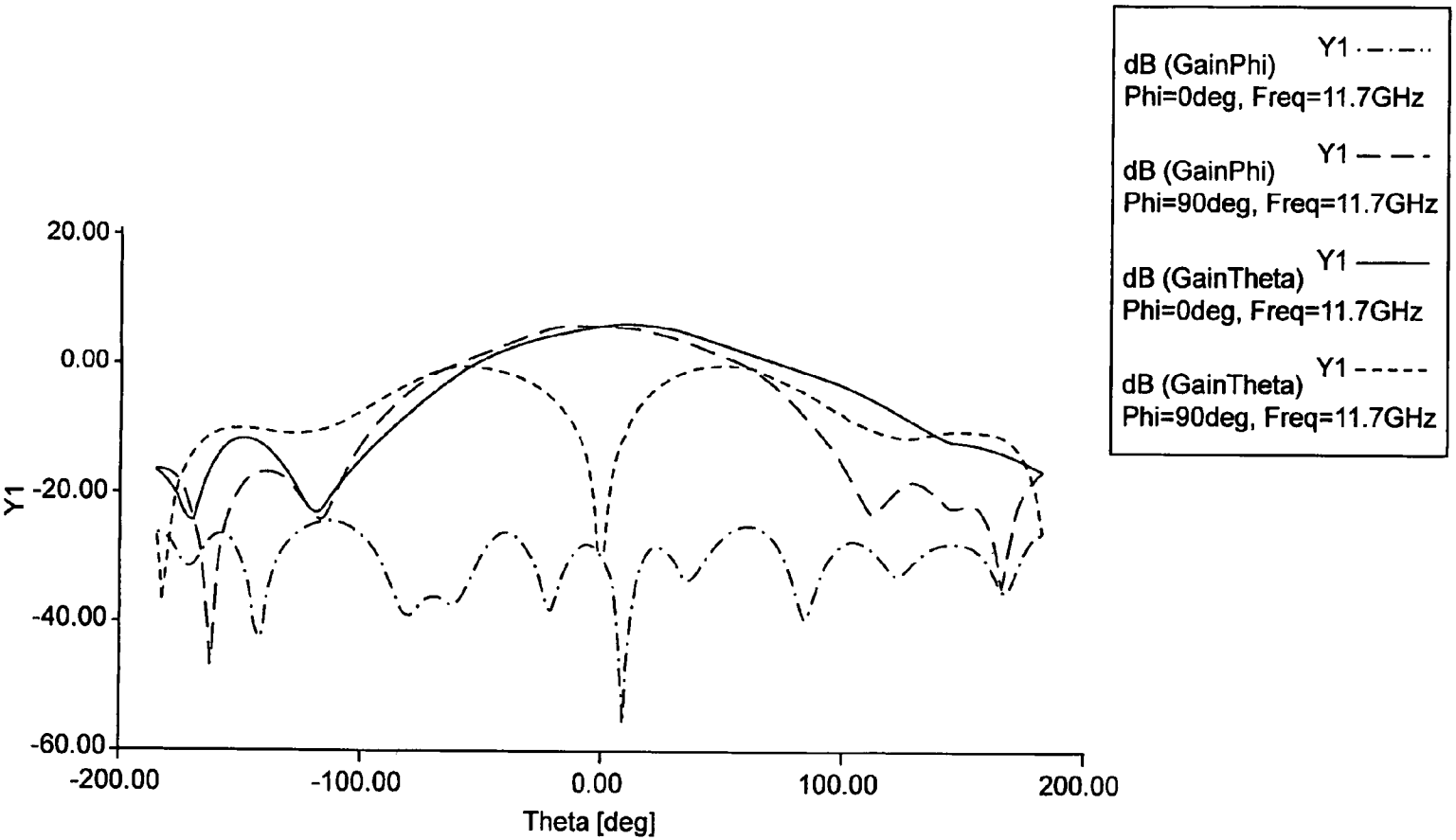
FIG. 5 is a graph illustrating antenna patterns at f1=11.7 GHz for the antenna of FIG. 1 if it were not to include the folded modified V-slot, with the remaining parameters being the same as FIG. 1.
Figure 6:
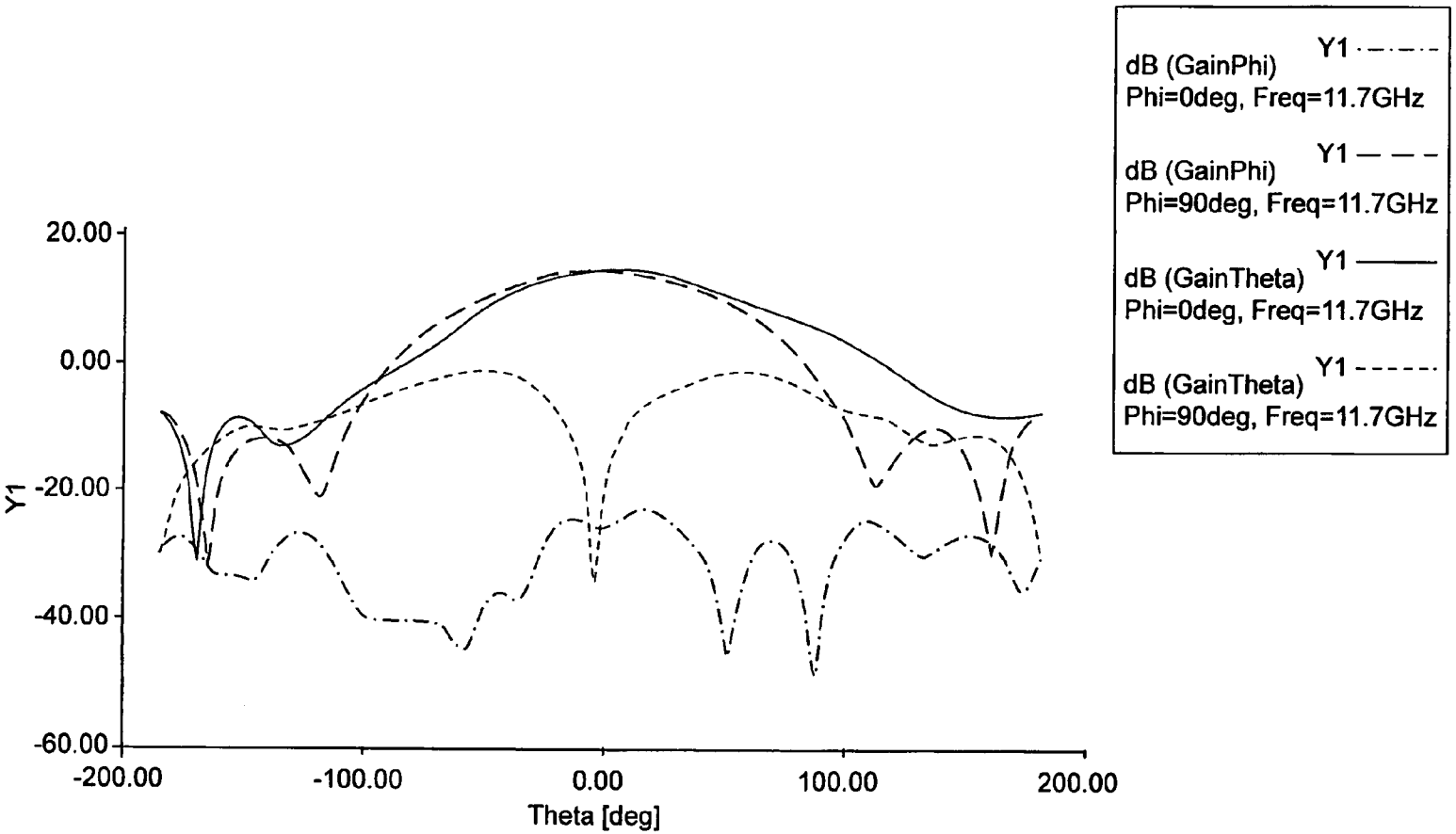
FIG. 6 is a graph illustrating antenna patterns at f1=11.7 GHz for the antenna of FIG. 1.
Figure 7:
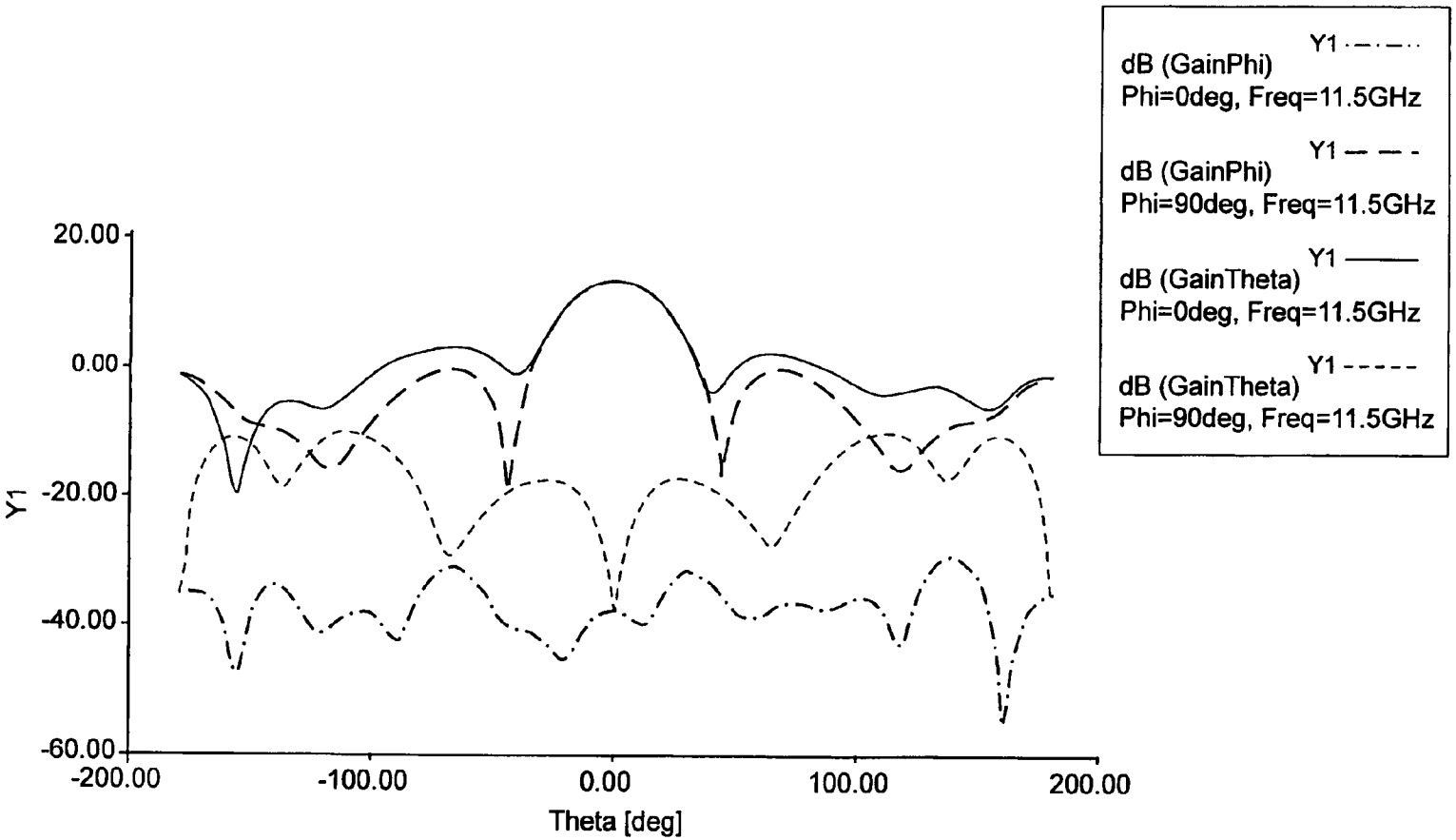
FIG. 7 is a graph illustrating antenna patterns at $f_1$=11.7 GHz for the 2×2 sub array of FIG. 2.

FIG. 5 is a graph illustrating antenna patterns (ϕ=0 & ϕ=90) at $f_1$=11.7 GHz, for the antenna of FIG. 1 without the folded modified V-slot, with the remaining parameters being the same as FIG. 1. FIG. 6 is a graph illustrating antenna patterns (ϕ=0 & ϕ=90) at $f_1$=11.7 GHz for the antenna of FIG. 1. The antenna maximum gain for single element with and without folded slot are 7 dBi and 8.5 dBi, shown in FIGS. 5 and 6, respectively. FIG. 7 is a graph illustrating antenna patterns (ϕ=0& ϕ=90) at $f_1$=11.7 GHz for the 2×2 sub array of FIG. 2. A 14 dBi gain is available for the configuration described by FIG. 7.

Applications and Arrays

There are two broad applications of antenna patches and arrays according to embodiments of the present invention. A linear polarization application is advantageously provided for use in internet access transmission over satellite. Linear polarization is also used in satellite DBS transmission in Europe. Circular polarization is used for DBS transmission.

A two by two block of antenna elements is the building block for any array of elements. For internet applications, some arrays that are used are two by four, two by eight, two by sixteen. In FIG. 2 an arrangement is shown for a linear polarization application.

Matching Network

Figure 8:
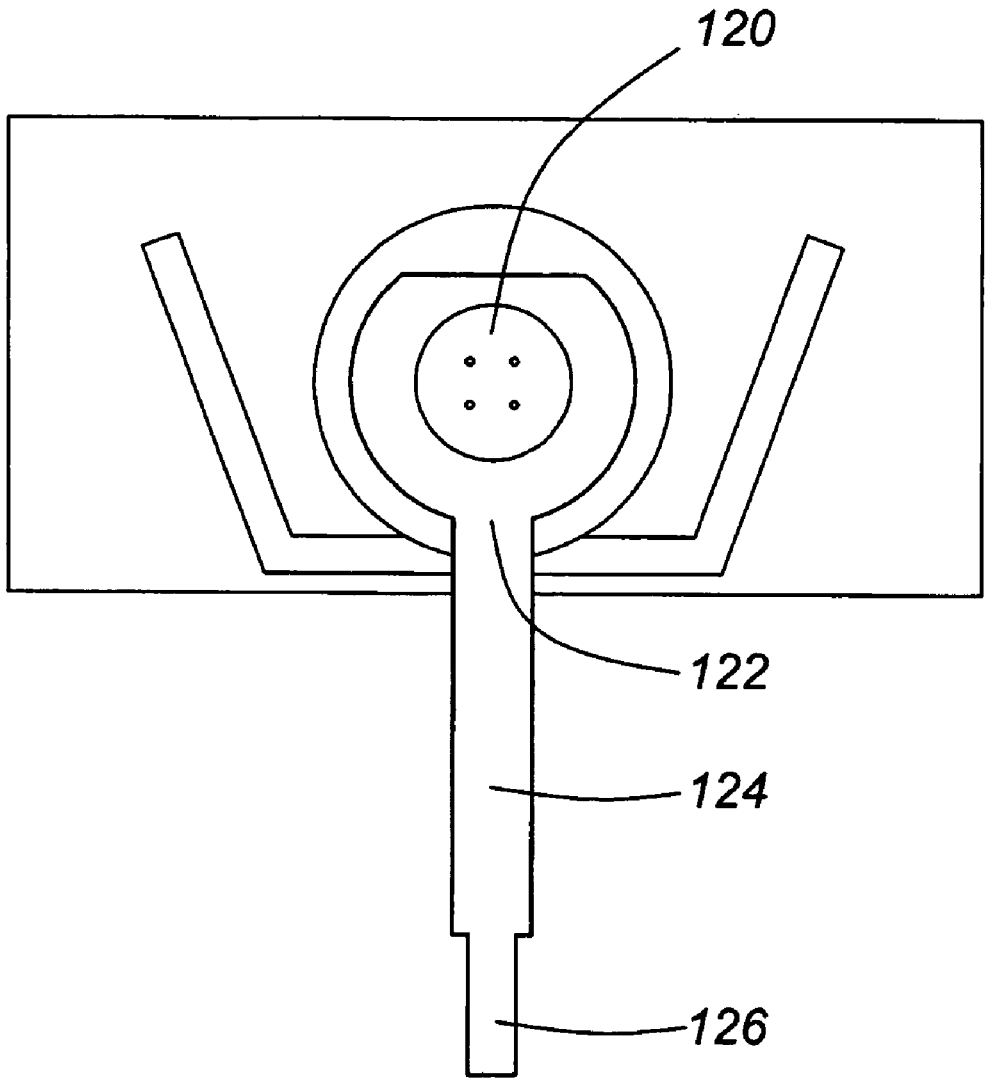
FIG. 8 illustrates a top view of a V-slotted patch antenna with matching and feeding network.

FIG. 8 illustrates a top view of a V-slotted patch antenna with matching and feeding network according to an embodiment of the present invention. The Impedance Matching Network which is shown in FIG. 8 is a novel wideband design which avoids the effect of feed radiation on the antenna radiation pattern. Since the design structure separates patch antenna layer from feed network layer, the feed radiation is blocked by the ground plane of the design. The impedance of the antenna structure at the center 120 of via-hole is $Z_{via_center}$=X+jY Ω based on the shape of pad used for the via-hole. At the edge 122 of via the impedance is $Z_{via_edge}$=Xp Ω which has only a real part. Using an impedance transformer 124, such as a λ/4 impedance matching network, this impedance is transformed to Xq Ω feed line 126. This structure shows very good matching over wide frequency range.

In terms of mathematical relationships between the impedances, a λ/4 transformer (quarter wavelength line) with an impedance of Z1 can match two impedances of Z0, and Z2 if Z1=SQRT(Z0*Z2).

As is shown in FIG. 8, the matching network portion around the via is cut off, or truncated, at the top of the circular portion. This cut off shape provides for wide band behaviour. In fact, the combination of the truncated circular portion, the impedance transformer with a first width, and a further impedance line after the impedance transformer having a different width cooperate to provide wide band performance. The circular patch with the portion of the circle cut off provides a particular contribution to the wide band performance.

In other words, the present invention provides a microstrip patch antenna system comprising a patch antenna layer having an antenna element. The antenna element can be a microstrip patch antenna element as described above. The microstrip patch antenna system further includes a dielectric layer having a via-hole, and a feeding and matching network layer having a wideband impedance matching network connected to the antenna element by way of the via-hole. The matching network includes a truncated circular segment having a first impedance, a feed line segment having a second impedance, and a transformer segment connected between the feed line segment and the truncated circular segment opposite the truncated portion, the transformer segment to match the first impedance and the second impedance.

Feed Network

Figure 9:
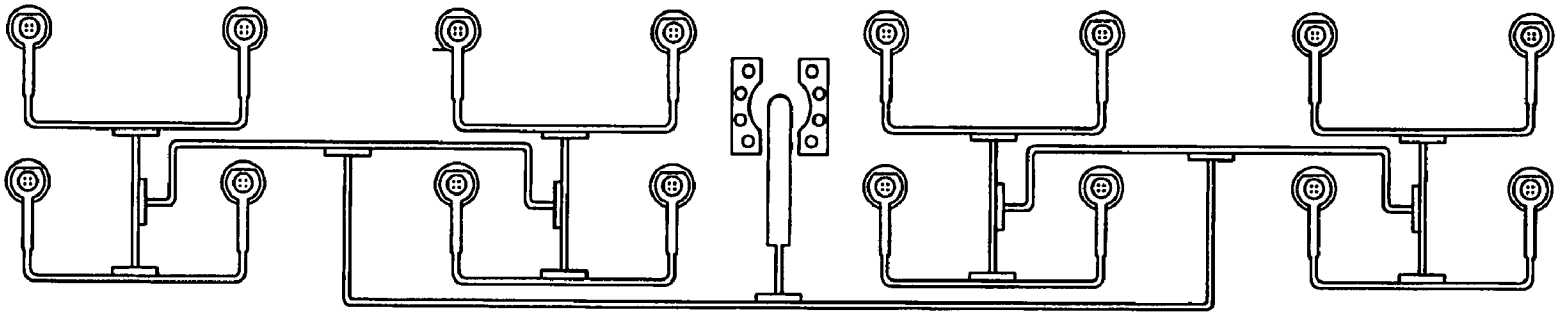
FIG. 9 illustrates a 2×8 microstrip patch phased array antenna feeding network with a matching network at the output.
Figure 10:
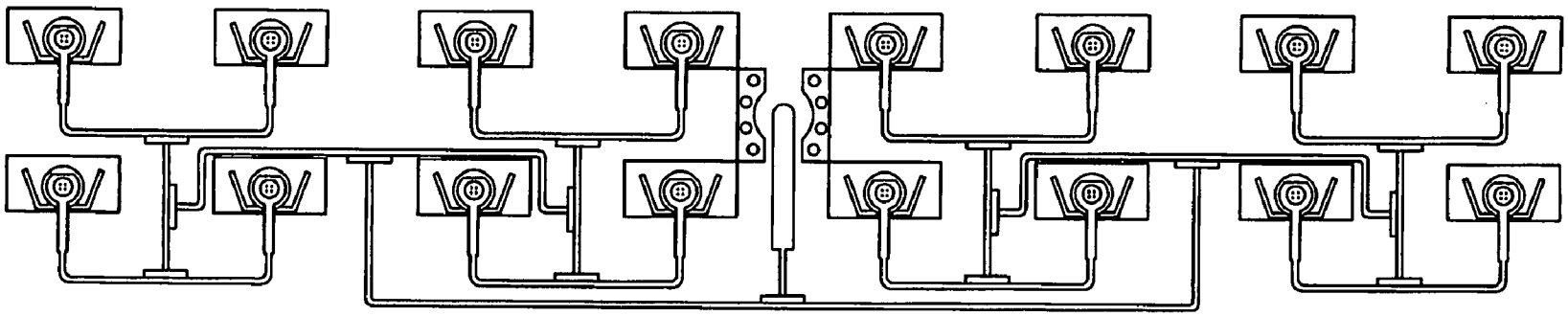
FIG. 10 illustrates a V-slot 2×8 antenna array with a feeding network.

A feeding network of a module of 2×8 microstrip patch antenna is shown in FIG. 9. In particular, FIG. 9 illustrates a 2×8 microstrip patch phased array antenna feeding network with 50-ohms matching network at the output. A V-slot 2×8 antenna array with its feeding network is shown in FIG. 10. In particular, FIG. 10 illustrates a 2×8 V-Slot rectangular microstrip patch phased array antenna feeding network with 50-ohms matching network at the output. The network is a T-junction power combiner concept that adds power of 16 antenna elements and through a 50 Ω impedance transformation provides a SMA surface mounted connector output. Each T-junction power combiner design is based on balance of power and phase combination of its inputs. The design is not sensible to manufacturing tolerances and shows very low insertion loss across the bandwidth.

The feed network can be provided as part of a feeding and matching network layer, as described earlier. In such a case, the feeding and matching network layer can include a feeding network having a power combiner to combine power of a plurality of antenna elements through an impedance transformation. The power combiner can include a T-junction power combiner based on balance of power and phase combination of its inputs.

Physical Implementation

Figure 11:
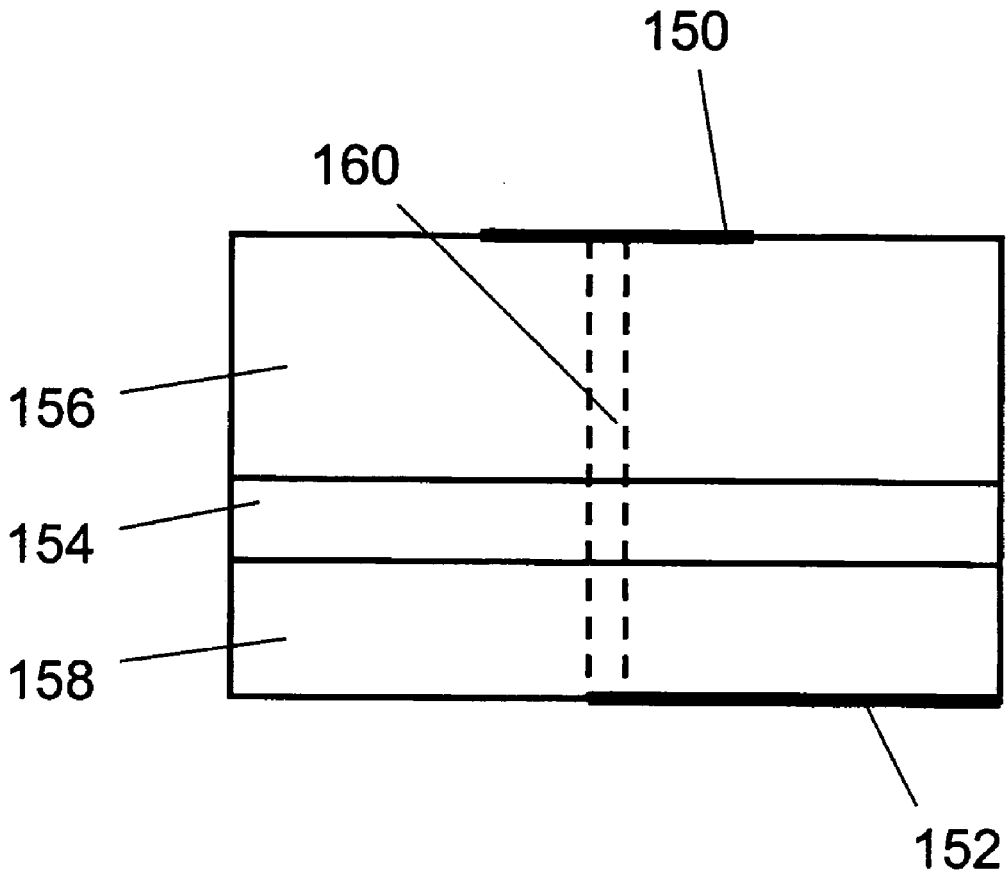
FIG. 11 illustrates a cross-sectional view of a patch antenna structure according to an embodiment of the present invention.

FIG. 11 illustrates a cross-sectional view of a patch antenna structure according to an embodiment of the present invention. The structure for the antenna which shown in FIG. 11 comprises two high frequency substrates 150 and 152 bounded together using a bounding layer 154. The first high frequency substrate 150 is a patch antenna layer, and the second high frequency substrate 152 is a feeding and matching network layer. The bounding layer 154 can be an FR4 bounding layer with 2.5 mils thickness, 4.5 relative dielectric constant and 0.018 loss-tangent. A top laminate, or layer, 156 is provided as part of the multi-layer board, and can be Rogers RT/Duroid 5880 with 62 mils thickness, 2.2 relative dielectric constant, 0.0009 loss-tangent and 1 ounce copper. A bottom laminate, or layer, 158 can be Rogers RO3003 with 20 mils thickness, 3 relative dielectric constant, 0.0013 loss-tangent and 1 ounce copper. The patch antenna is provided in the patch antenna layer 150, provided at the top layer 156. The feeding and matching networks are provided in the feeding and matching network layer 152, provided at the bottom layer 158. A via-hole 160 is provided in this embodiment to perform connection between the two layers, or substrates. The bottom layer 158 serves as the ground for the board. The slot on the ground surface avoids connection of via-hole to the ground and its diameter is preferably optimized to have maximum efficiency for the antenna.

Thermal coefficients of substrates can be −125 and 13 ppm/° C. for top and bottom laminates, respectively. Because of different thicknesses for the layers and different composites (glass reinforced PTFE for the top layer and ceramic filled PTFE for the bottom layer), during the bounding process, no significant warping is generated. So this antenna design is manufacturable and the via-hole is not susceptible cracking upon wide temperature variation.

Asymmetrical Antenna Array

Figure 12:
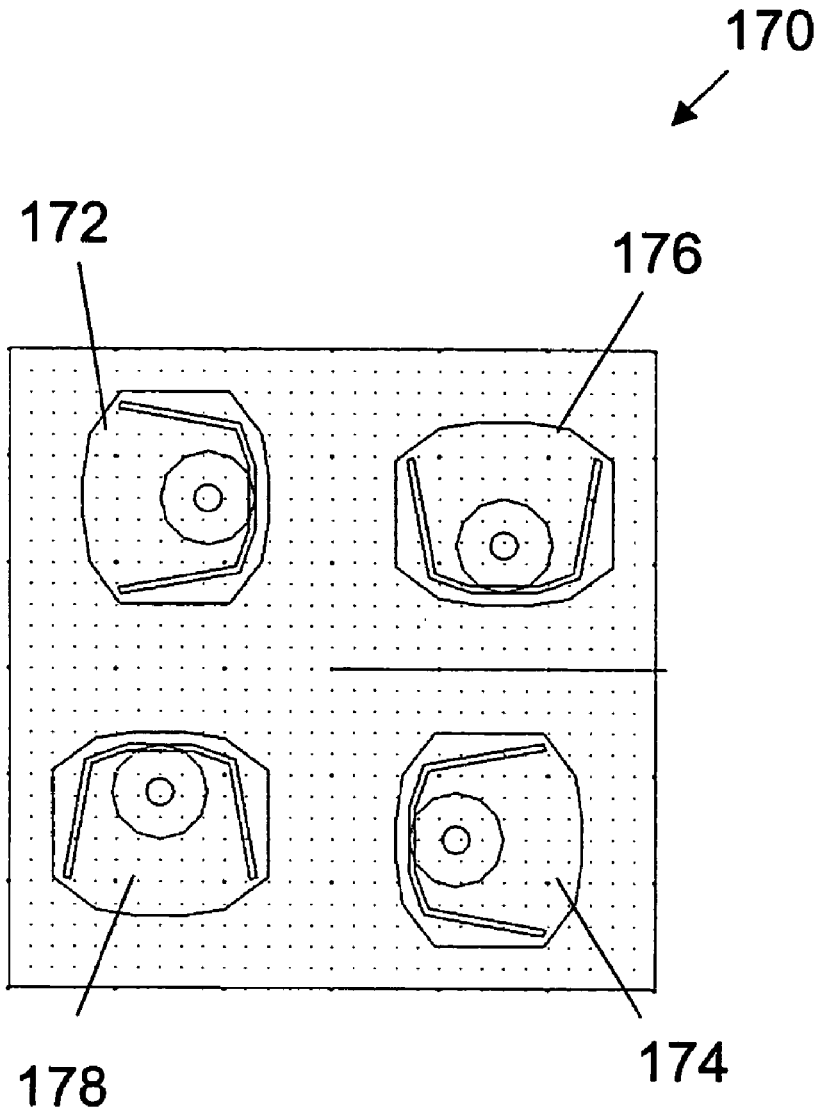
FIG. 12 illustrates an array of microstrip antennas for circular polarization according to an embodiment of the present invention.

FIG. 12 shows an array 170 of microstrip antennas according to an embodiment of the present invention. The array of FIG. 12 is for circular polarization suitable for DBS application. Typically, a 2×2 array of antenna elements must include four identical antenna elements. Embodiments of the present invention provide an asymmetrical array of microstrip antennas. Each of the microstrip antenna elements has a plurality of configurable elements or segments, such as the polygonal patch with modified V-slot described earlier. This arrangement gives a higher degree of freedom to allow for small perturbations to occur and still have optimized performance.

In the embodiment shown in FIG. 12, a 2×2 array of four microstrip antenna elements is provided. First and second microstrip antenna elements 172 and 174 are provided diagonally opposite each other, and are substantially similar to each other. In stating that the first and second microstrip antenna elements 172 and 174 are substantially similar to each other, this includes embodiments wherein they can be identical, or can vary with respect to small perturbations. Third and fourth microstrip antenna elements 176 and 178 are provided diagonally opposite each other as well, and are substantially similar to each other. The first pair of microstrip antenna elements (172 and 174) are not similar to the second pair of microstrip antenna elements (176 and 178). Of course, this example is only one embodiment. In another embodiment, each of the four microstrip antenna elements can be different from the others with no substantial similarity among them. Since each of the microstrip antenna elements has a plurality of configurable sections or parameters, those parameters can be configured/tuned in order to provide a desired overall performance, even with dissimilar elements in the same array.

In the configuration of FIG. 12, diagonally opposite patches are similar in shape but different from those patches of another diagonal. In another embodiment, the polygon shape of each microstrip patch in the 2×2 configuration can be different from each other to minimize the mutual effect between patches and increase the gain.

An asymmetrical microstrip patch antenna array is not limited to examples discussed herein. For example, such a patch configuration in 2×2 array can be provided for circular polarization or for linear polarization.

In other words, an asymmetrical array of microstrip antennas is provided including four microstrip patch antenna elements arranged in a square configuration. Each microstrip patch antenna element has a plurality of configurable elements. Diagonally opposite patches are substantially similar in shape but different in shape from those patches of another diagonal.

The four microstrip patch antenna elements can include: first and second microstrip patch antenna elements being substantially similar to each other in shape and performance and provided diagonally opposite one another; and third and fourth microstrip patch antenna elements being substantially similar to each other in shape and performance and provided diagonally opposite one another. The third and fourth microstrip patch antennas are dissimilar from the first and second microstrip patch antenna elements. The first, second, third and fourth microstrip patch antenna elements can each have at least eight configurable patch segments. The substantially similar pairs of elements can be rotated in phase with respect to each other.

The first, second, third and fourth microstrip patch antenna elements can each be a convex polygonal microstrip patch having at least eight side segments configurable with respect to the performance of the antenna. The patch can have a modified V-slot, a closed end of the modified V-slot being substantially parallel to the length of the base of the polygonal microstrip patch. The modified V-slot can include: a base segment defining the closed end; left and right V-side configurable segments each having a closed end edge and an open end edge; and left and right high-frequency control segments configurable to independently control response of the antenna element in two frequency bands. The left and right high frequency control portions are provided between and join an end of the base portion and the closed end edge of the left and right V-side portions, respectively. The polygonal microstrip patch and the modified V-slot co-operate to provide high-frequency, high-gain dual-band operation.

System Implementation

Reflector antennas with rather high gain are necessary for reception of signals for Ku band satellite communication. However, they cannot be used on moving platform such as cars and buses because of restriction on dimensions and aerodynamics. Relatively flat antennas are desirable for this type of applications.

Two examples of such a low profile antennas have been reported for digital broadcast satellite reception to cover South Korea and Japan. However, because these two countries are relatively small, scanning at elevation was not an important concern. In current research situation the coverage area is as large as, continental United States and Canada. This generally requires increase in the gain and elevation angular range at same time which are the conflicting requirements as the increase of antenna longitudinal dimension required for high gain, could generally lead to decrease in the beam scanning range.

A practical solution to this problem can be found by using hybrid phased array antenna with both electronic and mechanical beam scanning. The satellite tracking in this system uses mechanical scanning in azimuth and elevation for the coarse tuning. The electronic beam steering is used for both azimuth and elevation scanning, fine-tuning and compensation for the road condition. This method will reduce the number active and control elements while maintaining the high performance.

The system described here is a low profile system configuration for any phased array antenna systems for mobile (vehicular application) or stationary reception and transmission of signal through satellite. The special application is Ku, Ka band, land mobile DBS (Direct broadcasting satellite) and Internet.

Figure 13:
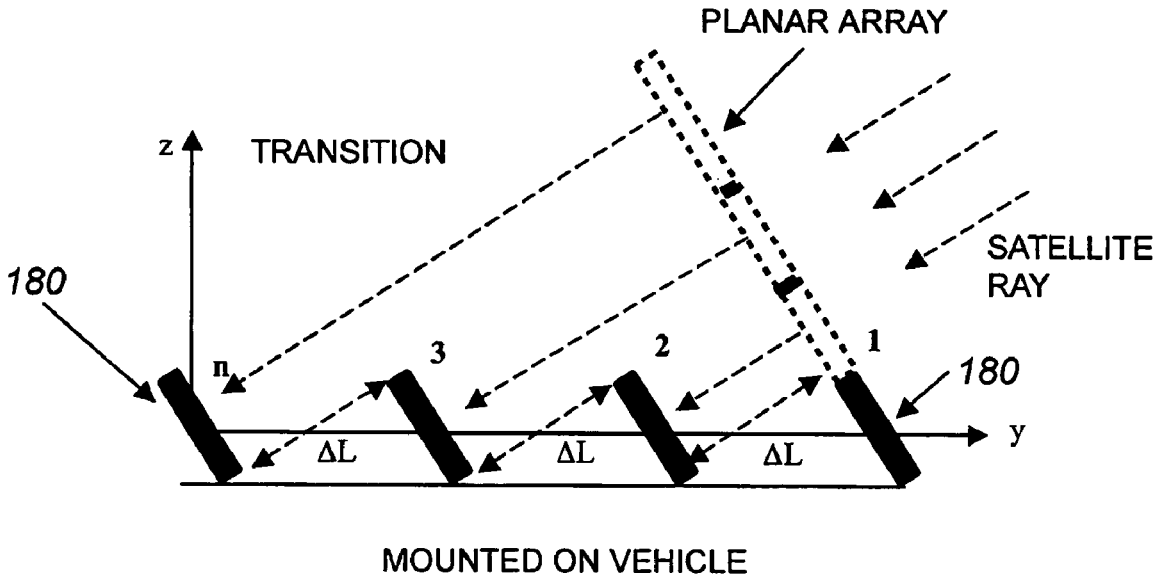
FIG. 13 illustrates a side view of a low profile stair-planar antenna array structure.
Figure 14:
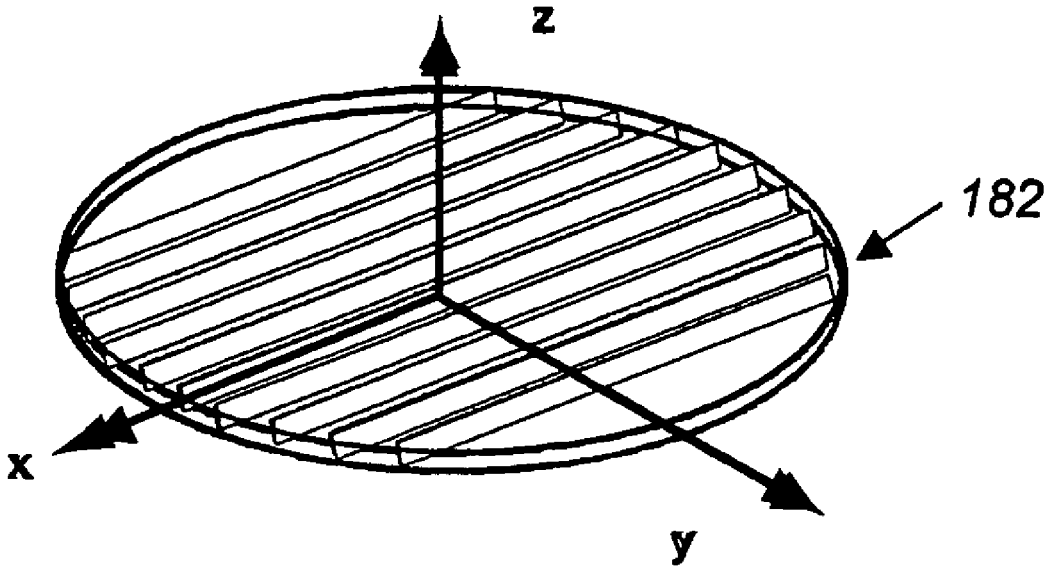
FIG. 14 illustrates a perspective view of a low profile stair-planar antenna array structure having unequal panel lengths.

Low profile is one of the important specifications. Therefore, a stair-planar array structure is preferably provided, as shown in FIG. 13, in which a large antenna is divided into a series of sub-arrays 180 located in parallel to each other. The height of the panels, on which the sub-arrays are preferably provided, is preferably equal, though this is not a necessary condition. The length of each panel can be either equal or non equal as shown in FIG. 14. The panels are located in such a way that they do not block each other for all elevation scan angles. The panels can rotate through a mechanical joint from 20 to 70 degrees in the y-z plane. All panels are mounted on a rotating plate 182, which can rotate in the x-y plane more than 360 degrees with the z-axis to be the axis of rotation.

Figure 15:
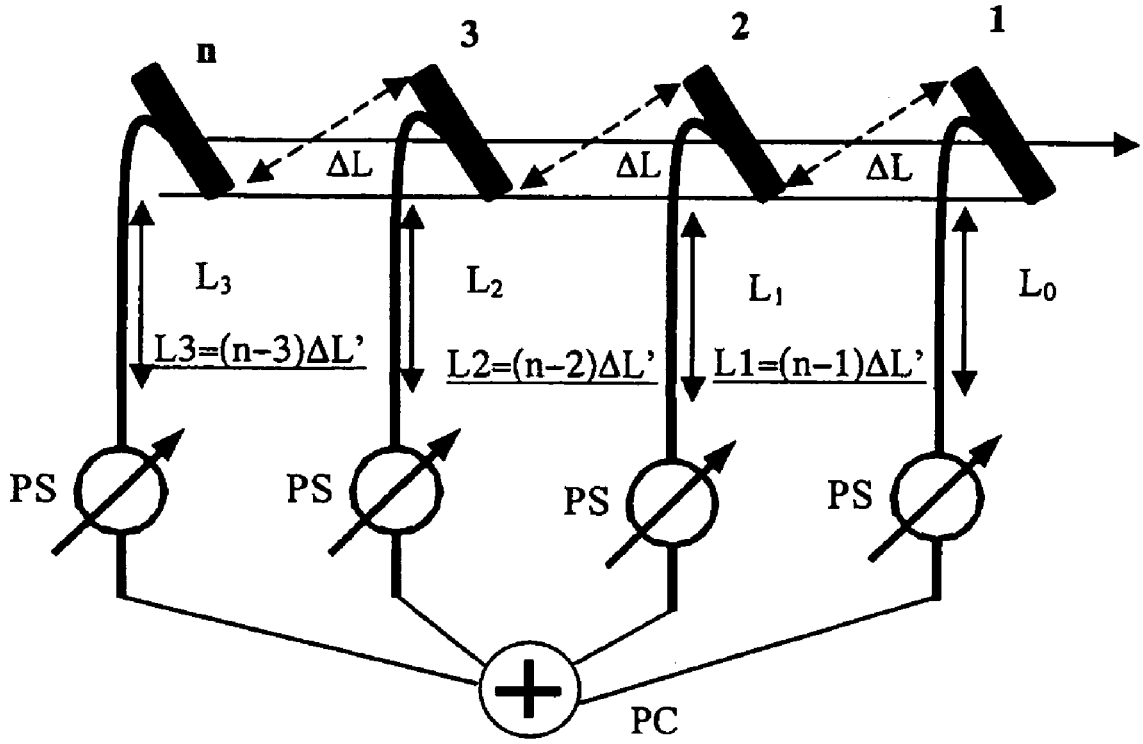
FIG. 15 illustrates RF cable length compensation for a stair-planar antenna array.

The rays coming from a satellite travel in plane wave formation. The first ray arrives at the panel 1 first then the second ray after traveling an extra distance DL gets to panel 2 and so on till the n ray reach to panel n travel an extra distance of (n−1) DL. This situation causes the phase error between the panels. Two treatments using RF cable length compensation (as shown in FIG. 15) and phase shifter compensation are applied.

We consider the RF cable length correction in order to treat a multi-planar array as a whole planar array. The required Li of each coaxial connecting between sub-array and phase shifter is $L_i=L_0+(n-i)\Delta L/\sqrt{\epsilon}$, where $L_0$ is the minimum length, $\epsilon$ is a permittivity of coaxial cable $\Delta L'=\Delta L/\sqrt{\epsilon}$ and $\Delta L$ is an average distance between panels when the panels rotate in elevation plane (here 20 to 70 degree). After the phase adjustment by the cable, the signal enters the phase shifter for fine phase adjustment and then combined by power combiner.

Figure 16:
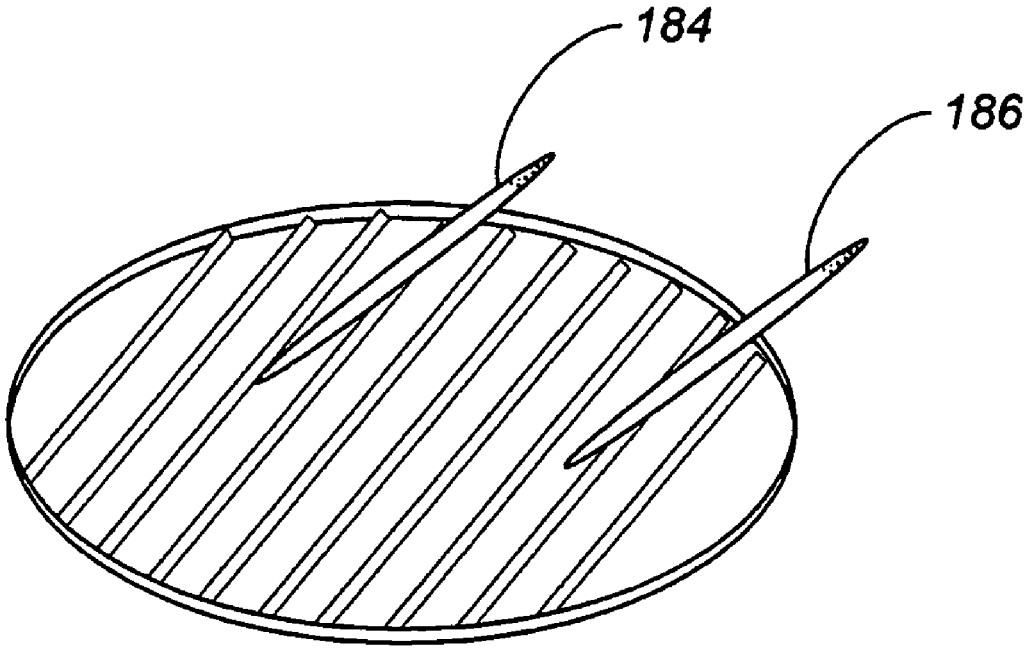
FIG. 16 illustrates a 10-panel ultra low profile phased array system according to an embodiment of the present invention with its associated LHCP and RHCP radiation patterns.

Tracking specifications of an ultra low profile phased array antenna system according-to an embodiment of the present invention will now be described. The system can comprise multi panel antenna arrays arranged in two groups: left hand circular polarization (LHCP) group and right hand circular polarization group (RHCP). Each group has its own radiation pattern. So the system would have two radiation patterns. FIG. 16 illustrates a 10-panel ultra low profile phased array system according to an embodiment of the present invention with its associated LHCP and RHCP radiation patterns, otherwise described as dual polarization radiation patterns.

Both radiation patterns 184 and 186 are almost the same: they are relatively narrow in azimuth direction and wide in elevation direction and side lobes levels are much suppressed however grating lobes exist.

In an alternative embodiment, instead of having two differently polarized groups of multi panel antenna arrays in the same antenna system, a plurality of systems can be provided for use with each other, with each system having differently polarized groups of multi panel antenna arrays. Each separate ultra low profile antenna system can then logically be considered to be a sub-system of the larger system. These sub-systems can preferably be provided in pairs, such that an over-arching system can include a dual configuration, or a four sub-system configuration, etc.

Figure 17:
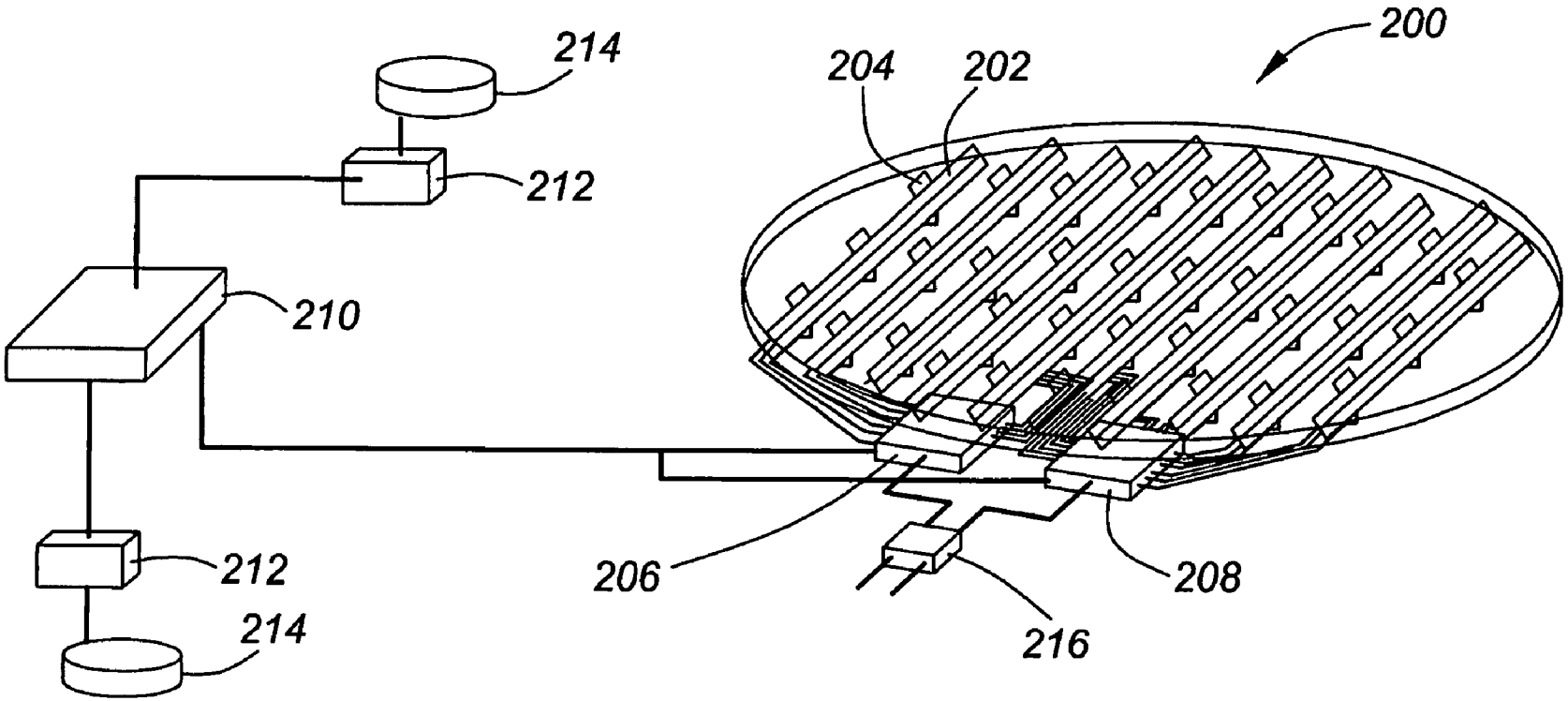
FIG. 17 is a block diagram of an ultra low profile phased array antenna system according to an embodiment of the present invention.

FIG. 17 is a block diagram of an ultra low profile phased array antenna system 200 according to an embodiment of the present invention. As shown in FIG. 17, each panel 202 of the 10-panel system comprises several modules which each module has its own LNA 204. The exemplary system in FIG. 17 has 17 modules for each polarization. The outputs of all module-LNA pairs for each polarization group are connected to a 17-to-1 phase shifter/power combiner board (PS-PC) . LHCP PS-PC board 206 and RHCP PS-PC board 208 are controlled by a Control Board 210.

Figure 18:
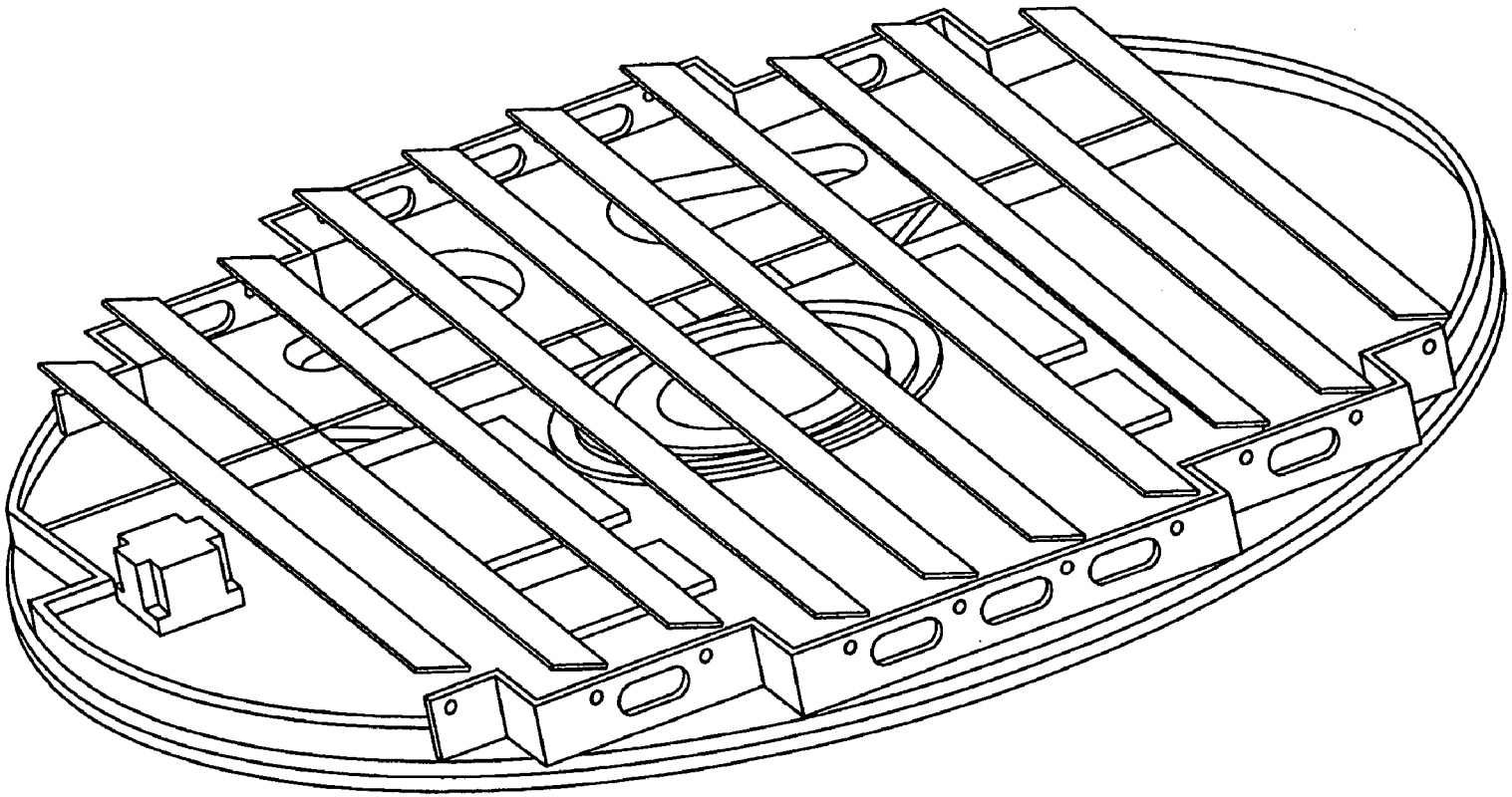
FIG. 18 is a perspective view of an ultra low profile phased array antenna system according to an embodiment of the present invention.

In FIG. 17, the control board 210 also controls two motor driver boards 212 driving two stepper motors 214. Both outputs of PS_PC boards go to an LNB 216 which provides outputs for satellite receivers. FIG. 18 is a perspective view of an ultra low profile phased array antenna system according to an embodiment of the present invention.

System tracking design is based on controlling phase shifters and stepper motors simultaneously. So the system is able to lock to the satellite and track it both mechanically and electronically. This specification improves drastically the tracking performance of the system and gives a huge advantage to it.

System Specification

Since the system has very low height, its radiation beam becomes very narrow in azimuth direction and because of the nature of the application, which is the mobile satellite terminal. Tracking performance in azimuth direction becomes important.

For normal low profile mobile satellite terminals, the beam width of the system in the azimuth direction is about 3~4 degrees. This beam width is enough to be able to track the satellite in almost every road conditions and driving skills. However, in the case of ultra low profile systems, which includes our system, the beam width in the azimuth direction becomes very narrow. For our system, the azimuth beam width is in the range of 0.5~0.7 degrees. Such a beam width makes the system very sensible to azimuth movements and fluctuations. One of the reasons for an ultra low profile system being so competitive in the market is this ultra narrow azimuth beam width.

Embodiments of the present invention overcome the sensitivity to the azimuth vibrations and noises by making the beam to be able to be steered electronically in the azimuth direction. The system also has the advantage of electronic beam steering in the elevation direction as well. In the following sections we describe the tracking specifications of the system.

Mechanical Beam Steering in Elevation Direction

The ultra low profile phased array antenna system is able to lock on and to track the satellite everywhere in the North America continent. This capability is achieved thanks to the innovative mechanical design of the system. The panels of the system are able to have a tilt angle varying from 20 degrees to 70 degrees range. This range, when added to the electronic beam steering capability of the system, makes the system able to lock and track the satellite everywhere from Alaska toward Florida plus some parts of Mexico.

Figure 19:
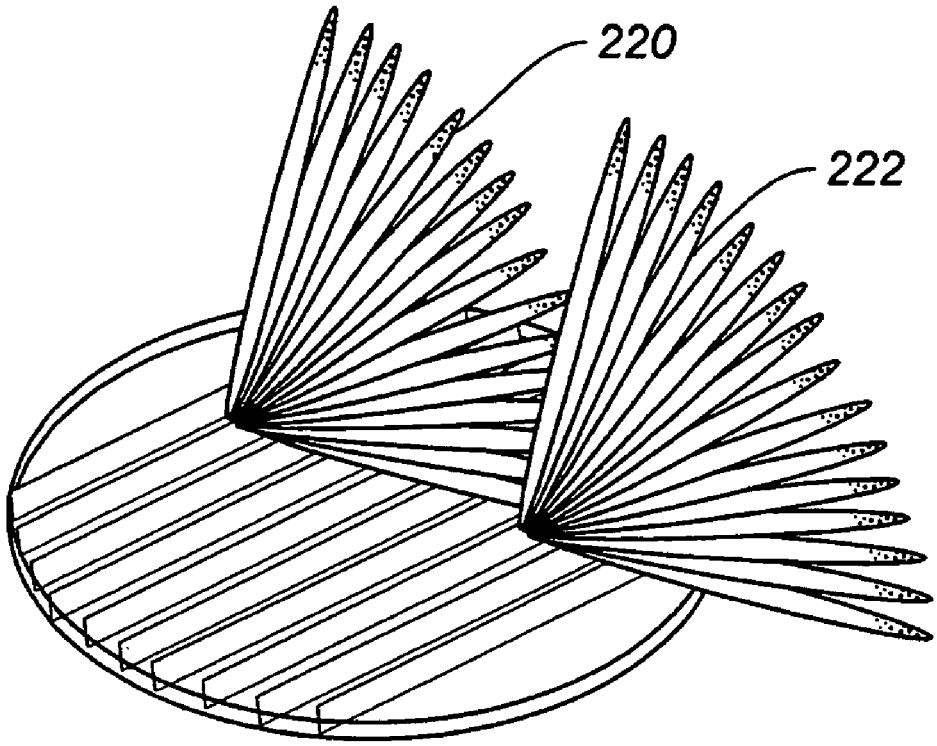
FIG. 19 illustrates mechanical beam steering in an elevation direction of an ultra low profile phased array antenna system.

FIG. 19 illustrates mechanical beam steering in an elevation direction of an ultra low profile phased array antenna system according to an embodiment of the present invention. In the figure dual beams 220 and 222 are scanning in the elevation direction in big steps to show how the beam will steer in that direction, however, in practice the pace of the steps is much smaller and almost a continues scanning is provided.

For each panel's tilt angle, a specific phase difference between successive panels should be applied to have the beam perpendicular to the panels. The look-up table in the tracking algorithm will provide the required data to put the panels in phase.

Mechanical Beam Steering of the System in Azimuth Direction

Figure 20:
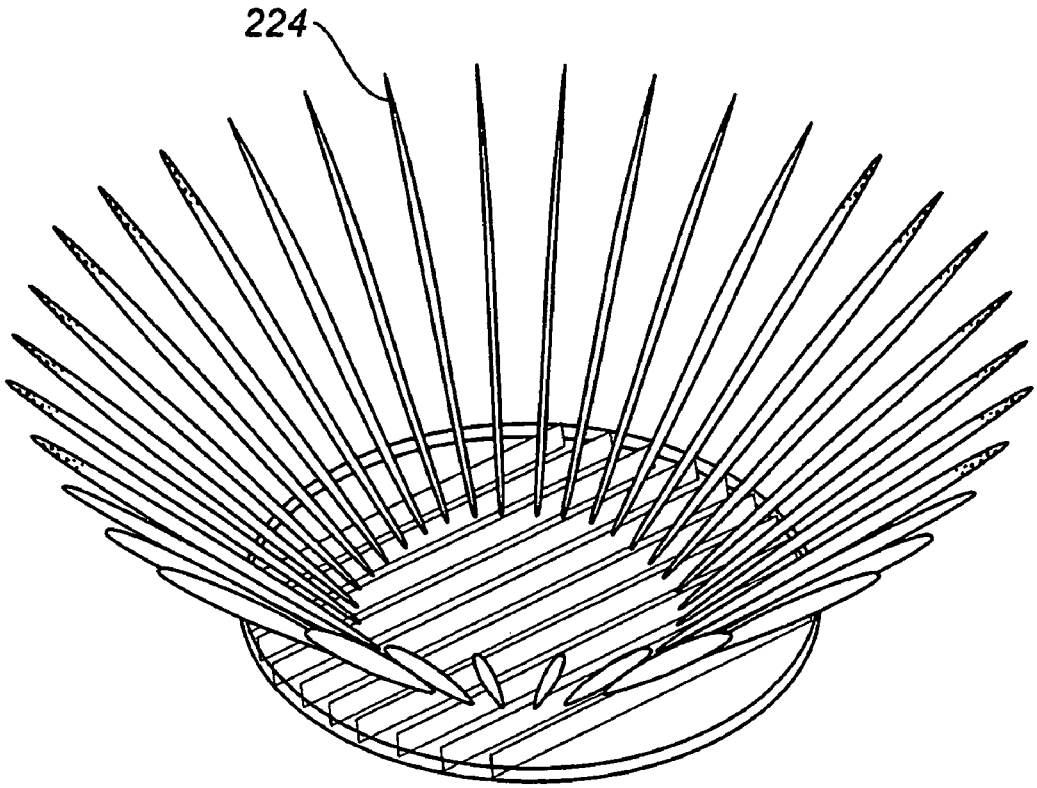
FIG. 20 illustrates mechanical beam steering in an azimuth direction of an ultra low profile phased array antenna system.

FIG. 20 illustrates mechanical beam steering in an azimuth direction of an ultra low profile phased array antenna system according to an embodiment of the present invention. The beam 224 scans in the azimuth direction.

Since the application of the system is intended for mobile users, the system should be able to scan the azimuth angle from 0 degrees to 360 degrees. The azimuth step-motor makes the system fully rotating in the azimuth direction and the rotary joint technique solves the signal transmission problem from the rotating platform to the fix platform.

The resolution of the steps in the azimuth direction is very high. With a step-motor of 52000 steps for single rotation, a resolution of less than 0.01 degrees can be obtained, which is sufficient for high precision mechanical adjustment. In some practical implementations, a resolution of 0.2 degrees for the system may be obtained. This number is still acceptable thanks to the electronic beam steering which offers fine tuning role in this case.

Electronic Beam Steering of the System

The system is able to steer its beam electronically in both azimuth and elevation directions. Since in electronic beam steering there is no need for mechanical movements, the steering speed is much faster than mechanical beam steering. By proper design of the control boards and minimizing the delays for DAC and ADC boards, it is possible to achieve an electronic beam steering speed of above 10 KHz. The range of steering angle in azimuth direction is ±3 degrees. That means beam width in azimuth according to embodiments of the present invention can be interpreted as 6 degrees which is enough for overcoming substantially all vibrations and noises in the azimuth direction.

Beam steering range in elevation direction is about ±5 degrees. This coverage range is important to avoid mechanical beam steering in the elevation direction for most of the tracking scenarios. Only for long traveling distances that produce big changes in elevation angles of the system with respect to the satellite, will cause mechanical beam steering in the elevation direction. This specification enables the system to provide very long lifetime because the cabling and connections of the panels are not moving very much.

Figure 21:
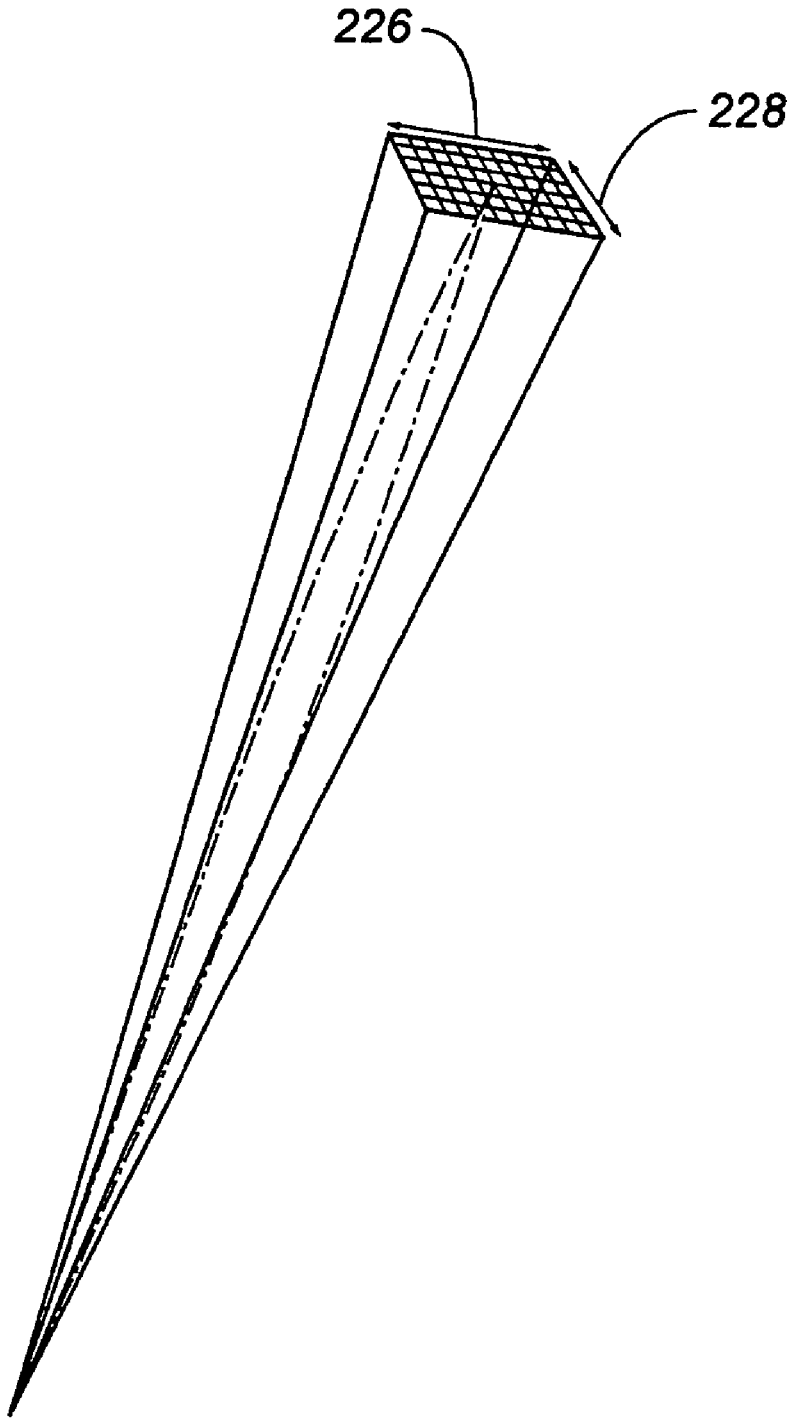
FIG. 21 illustrates electronic beam steering in elevation and azimuth directions.
Figure 22:
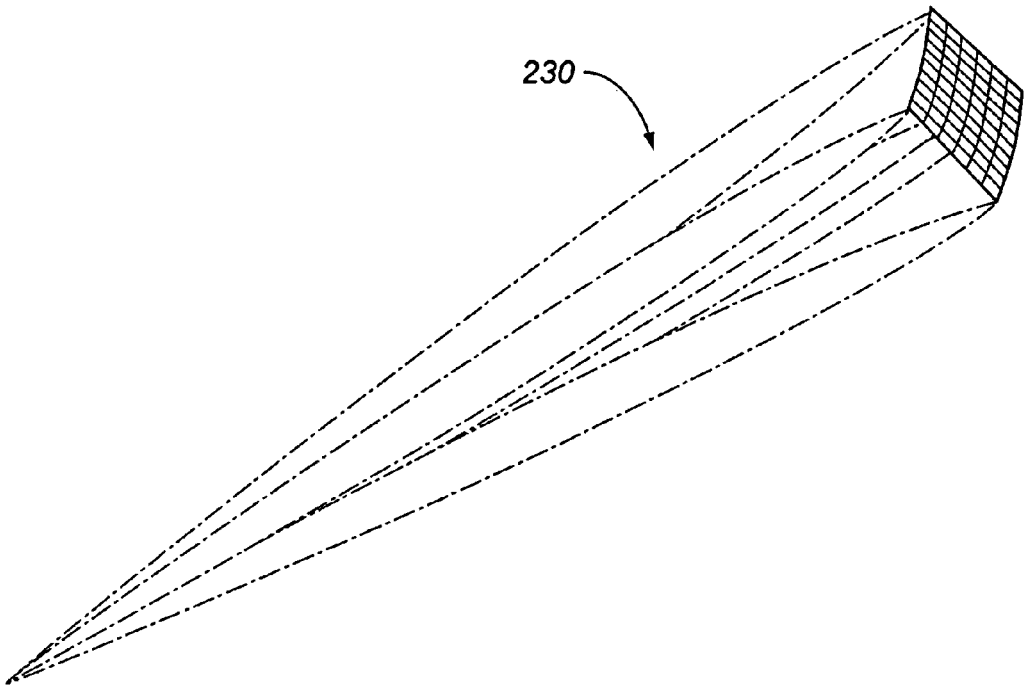
FIG. 22 illustrates an electronic beam steering range.

FIG. 21 shows a range of electronic beam steering in the azimuth and elevation directions. An azimuth electronic beam steering range 226 and an elevation electronic beam steering range 228 are shown. Depending on the resolution of the DAC board to control the phases of the phase shifters, the resolution of the electronic beam steering could be very high and in the range of thousandths of degrees. FIG. 22 shows the steered beam at four extreme angles of the coverage range and its initial position in the center of the range. An electronic beam steering range 230 is shown.

Method of Tracking

In order to point the antennae at the desired satellite position while the vehicle is moving, the antenna controller (preferably embodied in a microprocessor) steers the antenna beam electronically in both azimuth and elevation angle in response to RF detector to achieve motion compensation. The preferred embodiment uses accelerometers and yaw, roll, and pitch sensors to sense the yaw, pitch, roll rates, longitudinal and lateral acceleration of the vehicle and GPS and Gyro. The estimated yaw, roll and pitch rates are integrated to yield the vehicle yaw, pitch, and roll angle. This is used in a coordination transformation to the earth-fixed coordinate system to determine the azimuth and elevation travel of the antenna. The antenna will be turned in the opposite directions by the same amount to counteract the vehicle motion. Any resulting pointing error is detected by a dithering process and corrected by the antenna tracking system. Drift due to the inertia bias is the most significant source of pointing error and the tracking system compensates for it with dithering.

According to the antenna tracking algorithm, the antenna beam electronically is dithered to the left, right, up, and down of the target by a certain amount. The received signal strength indicator (RF detector) is monitored during this dithering action to determine the pointing error of the antenna beam. The antenna pointing is then adjusted toward the direction of maximum signal strength to refine the antennae tracking.

According to a preferred embodiment of the invention, the antenna controller obtains an estimate of the pointing angle error by "electronically dithering" the antenna position. Electronic dithering in the elevation and azimuth direction are achieved by changing (incrementing or decrementing) the phase shift of the phase shifters by a certain amount. This is equivalent to moving the antenna beam (upward or downward left and right) in elevation and azimuth.

The advantage of the "electronic dithering" is that the power required is reduced as compared to that required for constantly mechanically dithering the antenna assembly. A second advantage is that the "electronic dithering" can be performed at a much faster speed than the "mechanical dithering". Fast dithering operation means the antenna can track faster, which can eliminate the need for motion compensation and all the components (accelerometers and pitch, and yaw sensors) required by the motion compensation, resulting in a significantly lower cost implementation.

When the antenna assembly is first powered up, the controller microprocessor which controls the azimuth and elevation motors and commands the two motors to move and monitors the encoders to check if the two motors respond to the command. After that, the motion compensation algorithm is turned on. The antennae are moved to scan through possible satellite positions to search for a satellite signal. The typical method is to scan the 360 degree azimuth angle at a given elevation, incrementally change the elevation angle, and repeat the azimuth scan. Preferably, an electronic compass or GPS is utilized and the location of the satellite is known. Thus, it will not be necessary to scan the entire hemisphere, but only a relatively small region based on the accuracy of the compass and the satellite position. The antennae dither action is not turned on during the initial satellite location. The antennae controller monitors the RF detector via the power monitor. If the power monitor detects that the signal strength exceeds a certain threshold, the scanning is stopped immediately and the antennae dithering algorithm is turned on to allow the antennae to track the signal. The demodulator (receiver) and the data processor are monitored to see if the antennae are pointed at the desired satellite and if the signal is properly decoded. If that is the case, the signal lock is achieved. Otherwise, the antenna dithering is disabled and the scanning is resumed.

If the signal lock is achieved, the antenna tracking algorithm continues to refine the antenna tracking. The processor which controls the motors and phase shifters continues to report the motor position with a time tag. In the preferred embodiment, the motor position is translated into a satellite position (elevation and azimuth) in space. In the case that the signal is blocked by trees, buildings, or other obstacles, the power monitor and the receive data processor can immediately detect the loss of signal. The antenna tracking algorithm will command the motor controller and DAC to move the antenna back to point at the last satellite position recorded, when the satellite signal was properly decoded. In addition, upon loss of signal, the antenna dithering tracking algorithm will be temporarily turned off. If the power monitor detects the signal power (exceeding some threshold) again or the data processor detects the signal lock again, the antenna dithering algorithm will be turned on again to continue tracking. After a certain time-out period if no signal strength exceeding the threshold is detected by the power monitor or the data processor does not detect signal lock, the antenna scanning algorithm will be initiated to scan for signal again. The antenna-scanning algorithm for signal re-acquisition will scan in a limited region around the last satellite position recorded, when the satellite signal was properly decoded. If the scanning does not find the satellite signal, a full scan of 360 degrees of azimuth angle and all possible elevation angles will be conducted.

As mentioned earlier, an antenna according to an embodiment of the present invention can be provided in a PBG structure. A multi-layer antenna (stacked antenna) can be provided in which at least one antenna is an antenna according to an embodiment of the present invention. An array can be provided with two pairs of dissimilar antennas according to an embodiment of the present invention. An antenna according to an embodiment of the present invention can be used for DBS or Internet application through satellite. An antenna according to an embodiment of the present invention can be used as an array with any form of feed configuration to generate linear or circular polarization.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A microstrip patch antenna element comprising:

a convex polygonal microstrip patch having at least eight side segments configurable with respect to the performance of the antenna, the patch having a modified V-slot, a closed end of the modified V-slot being substantially parallel to the length of the base of the polygonal microstrip patch, the modified V-slot including:

a base segment defining the closed end;

left and right V-side configurable segments each having a closed end edge and an open end edge; and left and right high-frequency control segments configurable to independently control response of the antenna element in two frequency bands, the left and right high frequency control segments being provided between and joining an end of the base segment and the closed end edge of the left and right V-side segments, respectively, the polygonal microstrip patch and the modified V-slot co-operating to provide high-frequency, high-gain dual-band operation.

2. The antenna element of claim 1 wherein the convex polygonal microstrip patch has at least ten side segments.

3. The antenna element of claim 1 wherein the left and right high frequency control segments are provided at an obtuse angle to the end of the base portion in a direction away from the base of the polygonal microstrip patch.

4. The antenna element of claim 1 wherein the left and right high-frequency control segments are configurable to independently control a first frequency band lower limit and a first frequency band upper limit.

5. The antenna element of claim 1 wherein the left and right high-frequency control segments are configurable to independently control a second frequency band lower limit and a second frequency band upper limit.

6. The antenna element of claim 1 wherein the left and right V-side segments are provided at an obtuse angle to the left and right high-frequency control segments, respectively, in a direction away from the base of the microstrip patch.

7. The antenna element of claim 1 further comprising left and right additional high-frequency control segments provided at the open end edge of the left and right V-side segments, respectively.

8. The antenna element of claim 1 wherein the polygonal microstrip patch and the modified V-slot are substantially symmetrical with respect to a center axis perpendicular to the base of the microstrip patch.

9. The antenna element of claim 1 wherein the modified V-slot is provided substantially in the center of the polygonal microstrip patch.

10. The antenna element of claim 1 further comprising a feeding point provided substantially in the middle of the antenna element.

11. The antenna element of claim 10 wherein the feeding point comprises a via.

12. The antenna element of claim 10 further comprising a probe surrounding the feeding point and provided generally within a space bounded by the portions of the modified V-slot.

13. The antenna element of claim 1 wherein one of the two frequency bands comprises the Ku band.

14. The antenna element of claim 1 wherein one of the two frequency bands comprises the Ka band.

15. The antenna element of claim 1 wherein the two frequency bands comprise a 11.5–12.75 GHz reception band and a 14–14.5 GHz transmission band.

16. An antenna array comprising a plurality of microstrip patch antenna elements as in claim 1.

17. A microstrip patch antenna system comprising:

a patch antenna layer having a microstrip patch antenna element, the element comprising:

a convex polygonal microstrip patch having at least eight side segments configurable with respect to the performance of the antenna, the patch having a modified V-slot, a closed end of the modified V-slot being substantially parallel to the length of the base of the polygonal microstrip patch, the modified V-slot including:

a base segment defining the closed end;

left and right V-side configurable segments each having a closed end edge and an open end edge; and left and right high-frequency control segments configurable to independently control response of the antenna element in two frequency bands, the left and right high frequenc control segments provided between and joining an end of the base segment and the closed end edge of the left and right V-side segments, respectively, the polygonal microstrip patch and the modified V-slot co-operating to provide high-frequency, high-gain dual-band operation;

a dielectric layer including a via-hole;

a feeding and matching network layer having a wideband impedance matching network connected to the antenna element by way of the via-hole, the matching network comprising:

a truncated circular segment having a first impedance;

a feed line segment having a second impedance; and an impedance transformer segment connected between the feed line segment and the truncated circular segment opposite the truncated portion, the transformer segment to match the first impedance and the second impedance.

18. The microstrip patch antenna system of claim 17 wherein the impedance transformer segment comprises a $\lambda/4$ transformer segment.

19. The microstrip patch antenna system of claim 17 wherein the feeding and matching network layer includes a feeding network comprising a power combiner to combine power of a plurality of antenna elements through an impedance transformation.

20. The microstrip patch antenna system of claim 19 wherein the power combiner comprises a T-junction power combiner based on balance of power and phase combination of its inputs.

* * * * *